US006263819B1

(12) United States Patent
Gorustein et al.

(10) Patent No.: US 6,263,819 B1
(45) Date of Patent: Jul. 24, 2001

(54) LOW DRAG SUBMERGED DISPLACEMENT HULL

(75) Inventors: Robert Gorustein; Steven Loui, both of Honolulu; Gary Shimozono, Kapolei; Scott Lawrey, Honolulu, all of HI (US)

(73) Assignee: Pacific Marine Supply Co., Ltd., Honolulu, HI (US)

( * ) Notice: Subject to any disclaimer, the term of this patent is extended or adjusted under 35 U.S.C. 154(b) by 0 days.

(21) Appl. No.: 09/397,079

(22) Filed: Sep. 16, 1999

(51) Int. Cl.[7] ..... B63B 1/00
(52) U.S. Cl. ..... 114/61.3; 114/274
(58) Field of Search ..... 114/61.12, 61.27, 114/61.29, 61.3, 140, 274, 312, 330, 332

(56) References Cited

U.S. PATENT DOCUMENTS 3,157,145 * 11/1964 Farris et al. ..... 114/332
3,429,287 * 2/1969 Uram ..... 114/278
3,885,514 * 5/1975 Lauenborg ..... 114/288
3,947,906 * 4/1976 McLane ..... 114/332
4,819,576 * 4/1989 Shaw ..... 114/248
4,981,099 * 1/1991 Holder ..... 114/274
5,477,798 * 12/1995 Ness ..... 114/65 R
5,522,333 * 6/1996 Lang et al. ..... 114/61.12
5,544,610 * 8/1996 Harding ..... 114/312
5,645,008 * 7/1997 Loui ..... 114/274

* cited by examiner

*Primary Examiner*—S. Joseph Morano
*Assistant Examiner*—Andrew Wright
(74) *Attorney, Agent, or Firm*—Fitzpatrick, Cella, Harper & Scinto

(57) ABSTRACT

Low drag underwater submerged displacement hulls which can be used as independent vessels or as underwater displacement hull portions of a vessel whose main hull is at sea level are disclosed which have improved lift to drag ratios. The disclosed vessels have outer surfaces whose shapes are defined in plan and elevation by generally parabolic curves.

45 Claims, 26 Drawing Sheets

FIG. 2
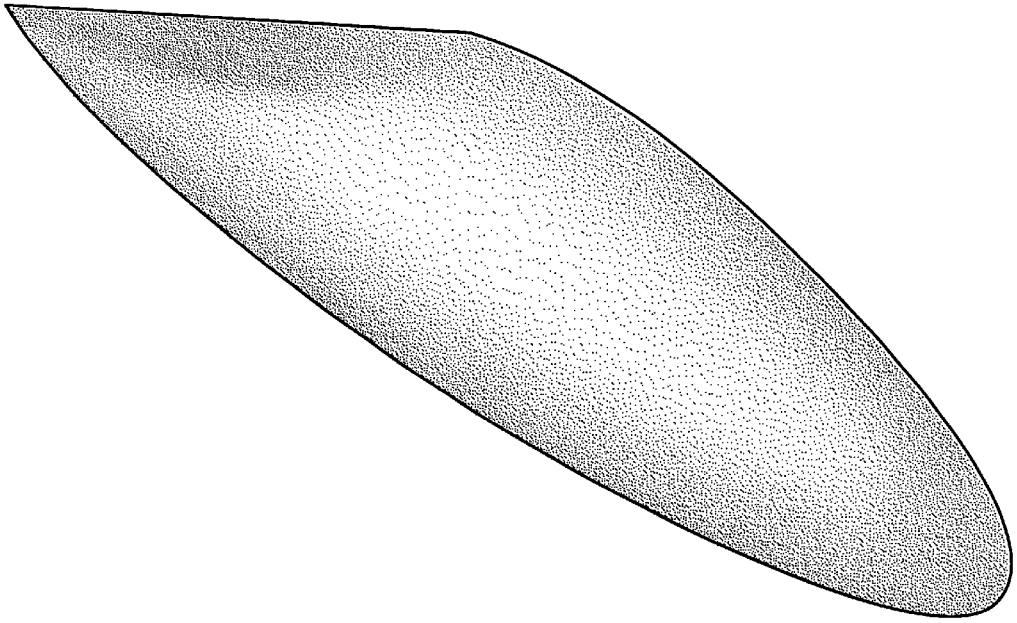
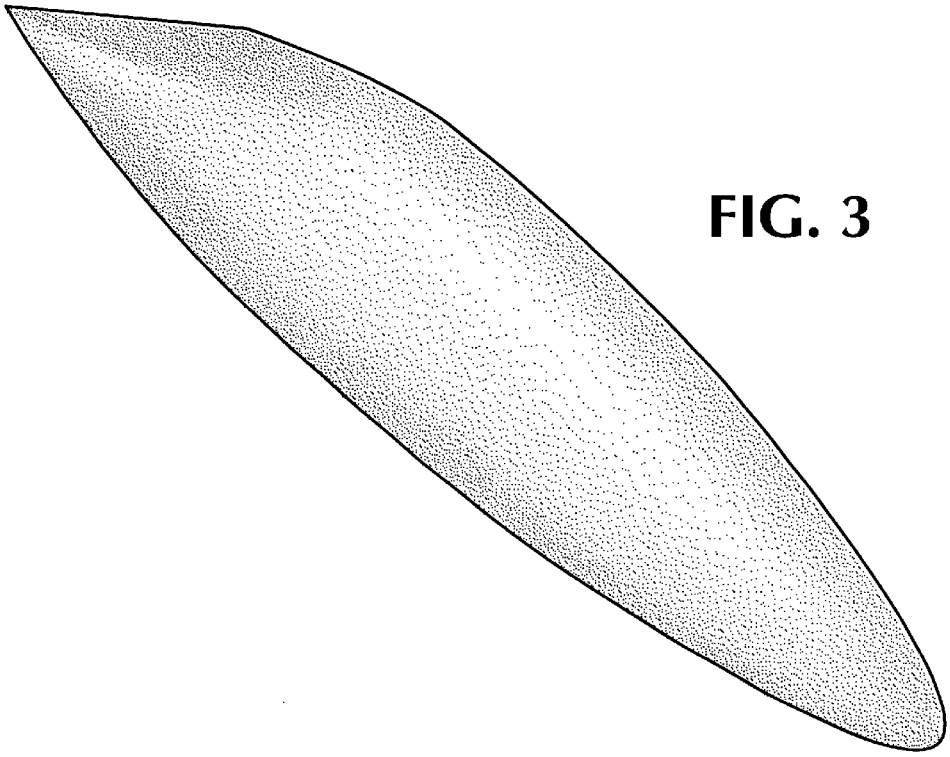
FIG. 3

FIG. 20A
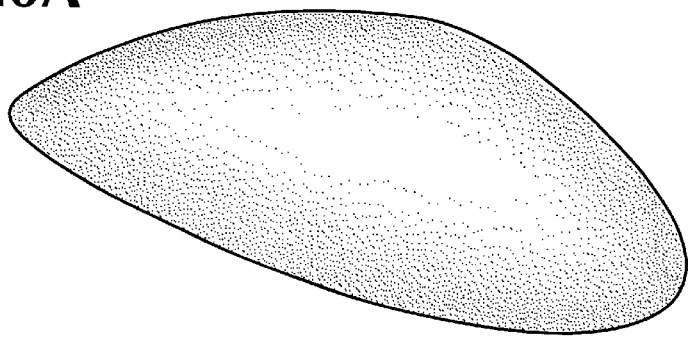
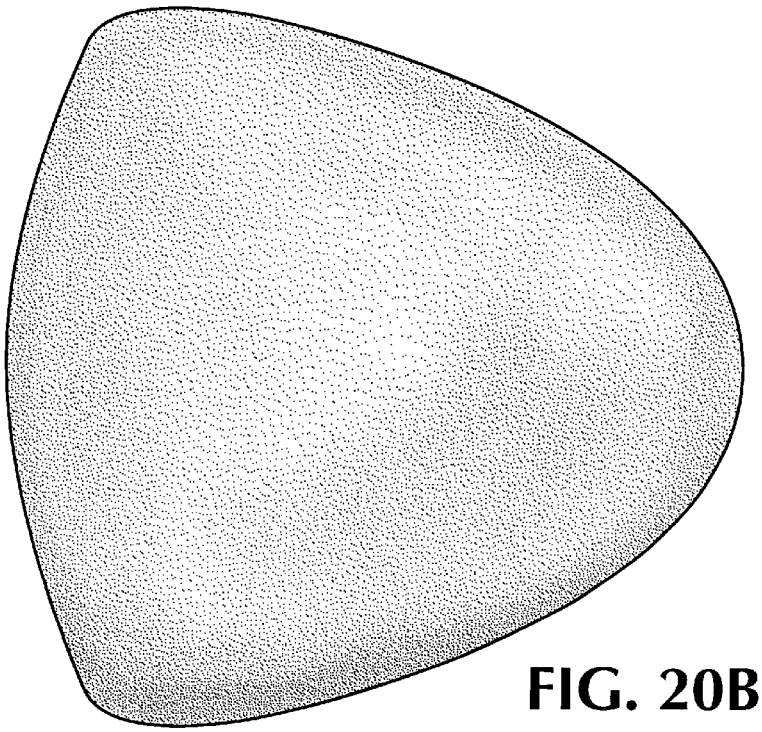
FIG. 20B
FIG. 20C
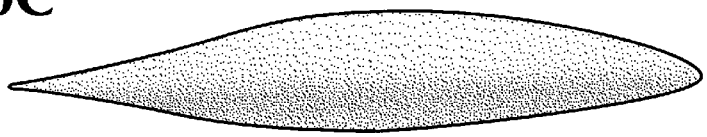
FIG. 20D
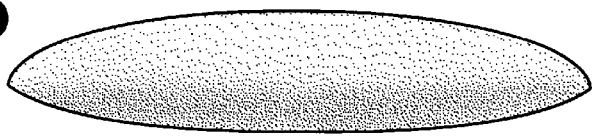

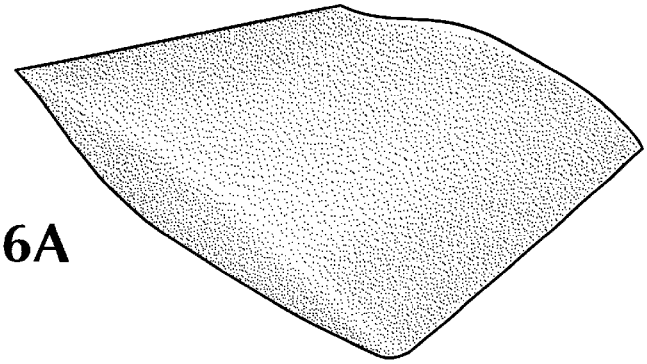
FIG. 26A
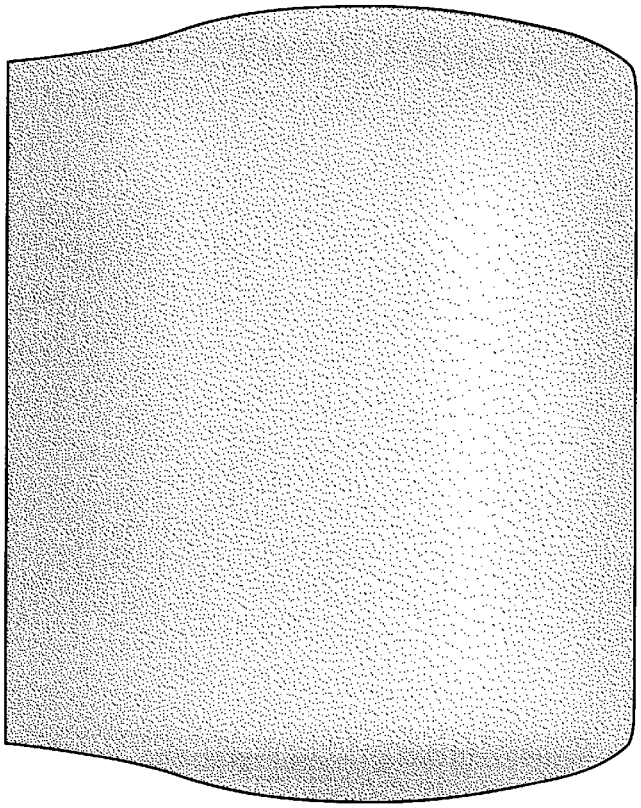
FIG. 26B
FIG. 26C
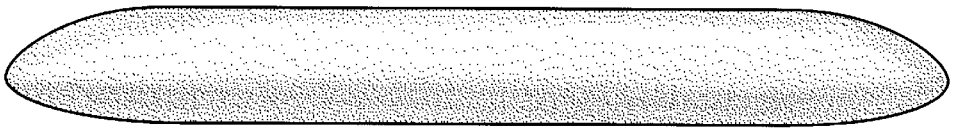
FIG. 26D
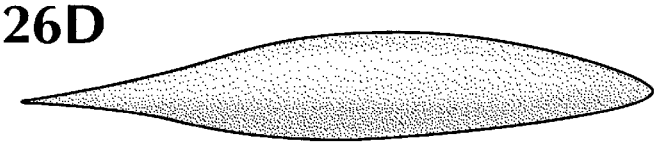

FIG. 27A
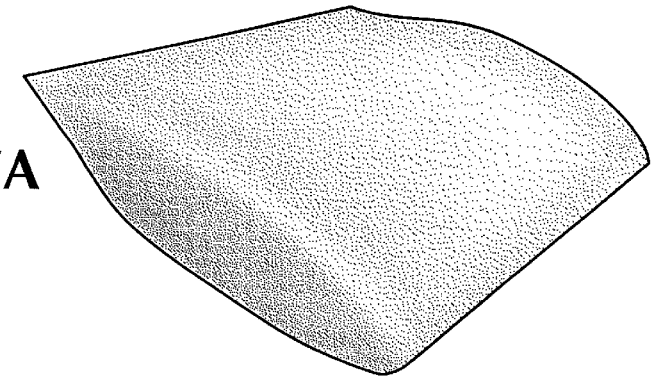
FIG. 27B
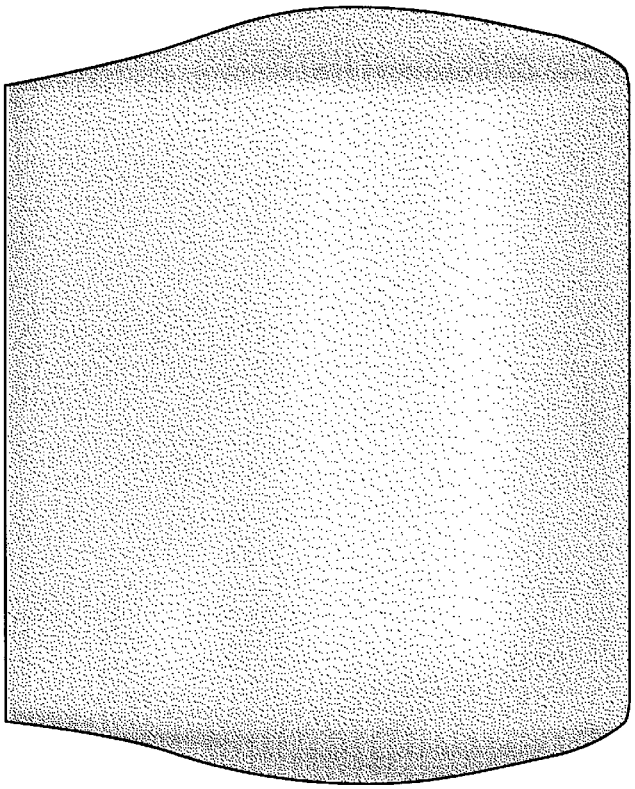
FIG. 27C
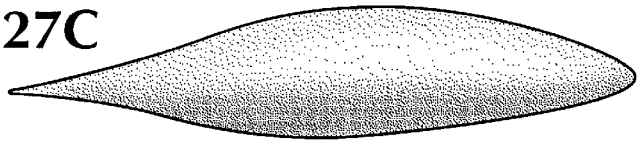
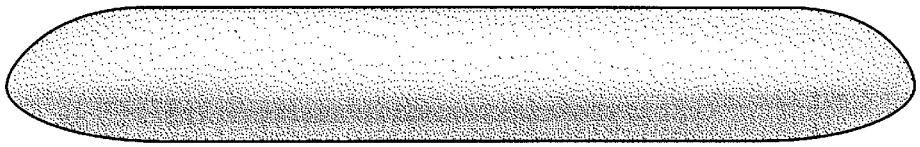
FIG. 27D

FIG. 33
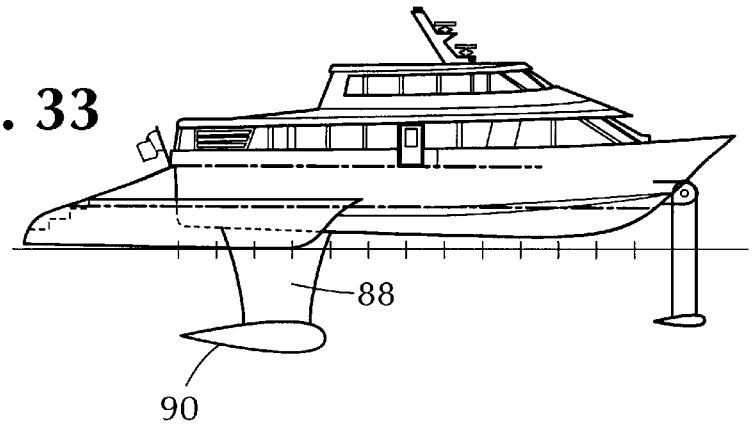
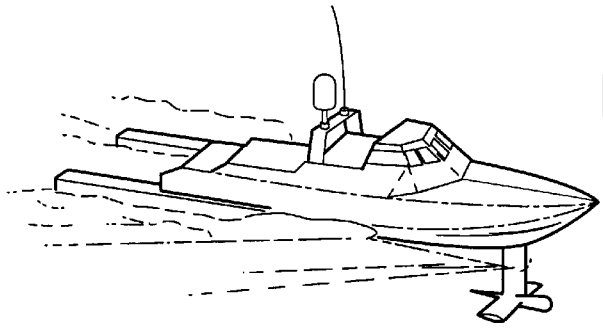
FIG. 34
(Prior Art)
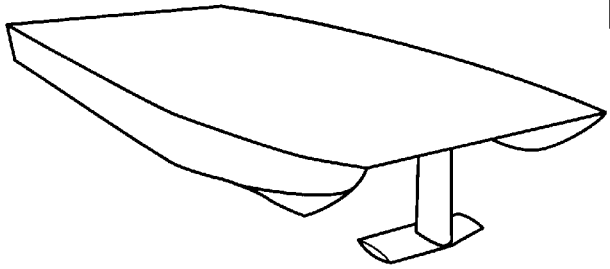
FIG. 35
(Prior Art)
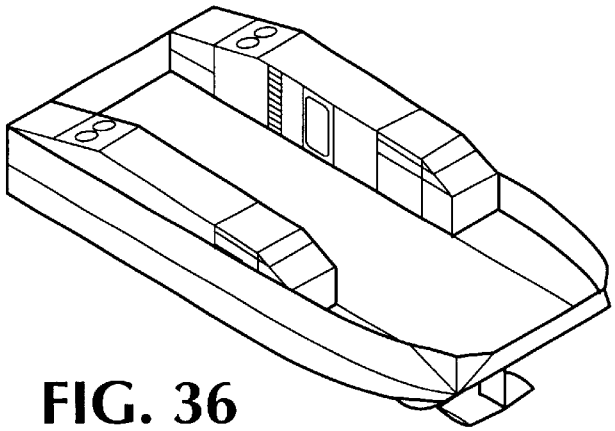
FIG. 36
(Prior Art)

LOW DRAG SUBMERGED DISPLACEMENT HULL

BACKGROUND OF THE INVENTION

1. Field of the Invention

The present invention relates to ships and watercraft having improved lift to drag ratios, and more particularly to hull structures which can be used as independent submerged vessels and/or as a submerged body which is part of a vessel that operates at sea level.

2. Background of the Invention

In recent years interest in the use of small waterplane area ships (SWAS vessels) has substantially increased because such vessels have improved hydrodynamic stability, low water resistance and minimal ship motion. Generally such vessels have at least one waterline located below its design draft with a waterplane area that is significantly larger than the waterplane area at its design draft. One form of such vessels is known as a small waterplane area twin hull vessel (a SWATH vessel) which generally consists of two submerged hulls, originally formed of uniform cross-section, connected to a work platform or upper hull by elongated struts which have a cross-sectional area along any given waterplane area that is substantially smaller than a waterplane area cross-section of the submerged hulls. Thus, at the design waterline such vessels have a small waterplane area.

The interest in such vessels has increased in large part because of the development work conducted by the assignee of this application, Pacific Marine Supply Co., Ltd. A variety of such vessels have been produced using twin submerged hulls or a plurality of submerged hulls, such as shown, for example, in U.S. Pat. No. 5,433,161. In the course of the development work for these vessels, further improvements have been made and a so-called Mid-Foil SWAS vessel was developed, as disclosed in U.S. Pat. No. 5,794,558. Such vessels use a lifting body or buoyancy foil which extends transversely of the main hull of the vessel and is submerged during operation. The foil is not a hydroplane foil but a lifting body which produces large hydrostatic and hydrodynamic forces. In the course of continuing development work, the particularized shape of such lifting bodies was studied in detail in order to improve the operation of such vessels.

More specifically, it has been found that the submerged bodies of marine vessels, when operated at shallow submergence depths, such as is the case for SWAS and Mid-Foil vessels, can be adversely effected by the displacement of the free water surface caused by the body's volume and dynamic flow effects. The interaction of that displacement of the free surface relative to the body's shape has not been adequately accounted for in the prior art structures. It is believed that this inadequacy of existing prior art submerged bodies for marine vessels is the result of the fact that submerged and semi-submerged marine vessels have historically been designed to operate at great depths relative to their underwater body thickness, as with submarines or hydrofoils.

A typical submarine is essentially a body of revolution-shaped hull which has three dimensional waterfowl about it, but which is designed to operate normally several hull diameters or more below the free water surface. Thus, the displacement of the free surface of the water by operation of the hull at such depths is minimal and does not effect the operation of the body. On the other hand, hydrofoils are simply submerged wings with predominately two-dimensional flow and are designed typically to produce dynamic lift as opposed to buoyant or hydrostatic lift.

The displacement of water at the free surface by a submerged body is detrimental to a marine vessel's hydrodynamic performance with the impact varying as a function of the body's shape, submergence depth, speed and trim. For example, the free surface effects can significantly reduce lift in the body or even cause negative lift (also referred to as sinkage) to occur.

Resistance to movement through the water by free surface effects is generally greater than if the submerged hull were operating at great depths; and pitch movements caused by the displacement of the free water surface vary with speed and create craft instability. With the advent in recent years of marine vehicles (such as the SWAS, SWATH, and Mid-Foil vessels) which use a shallowly submerged body the detrimental effects of free surface water displacement on submerged hulls has been recognized.

To date, submerged displacement craft hull body shapes are generally cylindrical or tear-drop shaped bodies of revolution. The simplest variations are bodies with generally elliptical cross-sections, such as are shown, for example, in U.S. Pat. Nos. 4,919,063 or 5,433,161. Others are simply shaped in a manner similar to an airplane wing, as shown for example, in U.S. Pat. No. 3,347,197. On the other hand, hydrofoil dynamic lift shapes are generally thin-foils with little or no buoyancy and symmetric foil sections having straight leading and trailing edges. In plan these foils are generally straight, or are swept forward or rearwardly and/or are trapezoidal in shape. Additionally, they can have dihedral or anhedral canting from the horizontal. It has been found that the performance of vessels using these shapes is adversely effected by the displacement of the free surface of the water above the bodies during operation of the vessel.

It is an object of the present invention to provide a submerged hull body which can be employed on various marine vessels to maximize performance of the vessel by creating a high lift to drag ratio (L/D), i.e., low drag, at operational speed.

Another object of the present invention is to provide a submerged hull body for use on various marine vessels which improves performance of the vessel at operational speed while creating a dynamically stable vessel.

Yet another object of the present invention is to provide a submerged hull body for use on various marine vessels or as an independent vessel which has optimal performance at operational depth with a high lift to drag ratio, dynamic stability and which is relatively easy to construct.

A further object of the present invention is to adapt these improved submerged hulls to a variety of watercraft.

Yet another object of the present invention is to produce a submerged hull shape which is adapted to be used as the submerged portion of a vessel whose visible hull operates at or about sea level but which also can operate as an independent vessel at submerged depths.

Another object of the present invention is to provide a submerged hull shape adapted to be used on catamarans, monohulls, multihulls, hydrofoils, and displacement vessels to supplement the vessel's buoyant and dynamic lift with minimal drag.

A further object of the present invention is to provide a submerged hull shape which is stable in operation at low speeds.

Yet another object of the present invention is to provide a submerged hull which has improved sea-keeping ability throughout its range of speed.

A still further object of the present invention is to provide improved propulsive efficiency for submerged vessels.

Yet another object of the present invention is to improve the lift to drag ratio (L/D) for a submerged hull throughout its range of speed in order to improve payload and speed, and/or reduce power necessary to operate the vessel.

Yet another object of the present invention is to reduce the wave making and wash of a vessel.

SUMMARY OF THE INVENTION

In accordance with an aspect of the present invention, a low drag underwater submerged displacement hull is provided that meets the above objectives. Generally, the hull is defined from two parabolic shapes. The periphery of the hull when viewed in plan is defined by a first parabolic form (or parabolic equation) with the form defining the leading edge of the hull. The longitudinal cross-section of the hull is formed of foil shaped cross-sections which are defined as cambered parabolic foils having a low drag foil shape and providing a generally parabolic nose for the hull. Generally, each longitudinal cross-section of the hull parallel to the longitudinal or fore and aft axis of the hull has a symmetrical cambered parabolic foil shape with the cross-section along the longitudinal axis of the hull having the maximum thickness and the cross-section furthest from the centerline of the hull having the minimum thickness. In plan, the hull has a stern or trailing edge which is defined by either a straight line, a parabolic line, or a straight line fared near its ends to the side edges of the plan parabola shape.

In another embodiment the hull shape is a parabolic body of revolution. In a third embodiment the hull also has a foil shape in longitudinal cross-section which is essentially formed by a parabolic body of revolution cut in half and separated by a uniform midships section, whose longitudinal cross-sections are uniform in shape and correspond to the parabolic shape of the body of revolution.

Preferably, in each case, the aft section of the longitudinal cross-sections of the hull taper from a maximum point of thickness to a minimum point of thickness at the stern. It has been found that such bodies should have an aspect ratio of between 10 to 150%, and that their thickness to length ratio should be between 10 and 33%.

It has been found that these body shapes have benign pressure gradients and small stagnation points over the body which make the bodies less sensitive to changes in the body angle of attack relative to the flow so that they are less effected by free water surface disturbance. Parabolic foil embodiments have high block coefficients which maximize their volume to surface area relationship with the result that they have less frictional drag because of reduced wetted surface area, less structure and thus less cost. As will be understood by those skilled in the art, the term block coefficient compares foil area in longitudinal cross-section to the area of a surrounding rectangle. An airplane wing, for example, will have a block coefficient of 50%. With higher block coefficients, such as the 60–70% coefficients achieved with the present invention, the volume of the foil relative to its surface area is maximized and, as a result, the foils of the present invention provide greater buoyancy for the same surface area as compared to the prior art.

Because of their high block coefficient, high displacements can be achieved with the hulls of the present invention having relatively short bodies. This allows these bodies to operate at high Froude numbers, preferably in excess of 1. This in turn results in less wave making drag and less friction drag from a thinner boundary layer. Wakes formed by these bodies are very uniform and result in minimal disturbance beyond the trailing edge to appendages bodies, or propulsers positioned at the trailing edge or stern. The parabolic foils, at critical design submergence depths, displace the free surface of the water in a manner which reduces the pressure coefficient on the bodies and allow higher incipient cavitation speeds. Their dynamic lift can then be varied as a function of camber (i.e. variation of the surface location from the design parabola), submergence, speed and angle of attack. As a result, optimization of lift characteristics for a given craft design speed and draft can be achieved. Further, dynamic lift of these bodies can be varied by the use of integrated trailing edge flaps, which will mitigate appendage drag of non-integral foil stabilizers.

The improved characteristics of the hull bodies of the present invention have been found to be useful in a variety of applications. They can be used as the submerged hulls of SWAS, SWATH, and Mid-Foil vessels; they can be appended to hydrofoils such as foil cats or monohull hydrofoils; they can be appended to hybrid hydrofoil planing craft hulls and hybrid hydrofoil displacement craft hulls. They also can be used as the submerged hulls in vessels such as shown U.S. Pat. No. 3,347,197 and independently as an independent submerged craft which will have a high level of stability at different immersion depths as a function of the craft's speed.

The above, and other objects, features and advantages of this invention will be apparent to those skilled in the art from the following detailed description of illustrative embodiments of the invention which is to be read in connection with the accompanying drawings wherein:

BRIEF DESCRIPTION OF THE DRAWINGS

FIGS. 1, 2 and 3 are perspective views of three forms of one embodiment of a foil-shaped lifting body constructed in accordance with the present invention;

FIGS. 20A–20D are similar to FIGS. 18A–18D but for an embodiment having a parabolic stern edge;

FIGS. 26A–26D are similar to FIGS. 16A–16D but for the embodiment of FIG. 22B;

FIGS. 27A–27D are views similar to FIGS. 16A–16D but for the embodiment of FIG. 23D;

FIG. 33 is a side view of the vessel of FIG. 35 using a lifting body constructed in accordance with the present invention;

FIGS. 34, 35 and 36 are perspective views of other forms of vessels to which the lifting body of the present invention, as illustrated in FIG. 36, may be adapted.

DETAILED DESCRIPTION

As discussed above the hull shapes of the present invention were developed as the result of research by applicant with respect to submerged displacement hulls for use in vessels similar to the SWAS, SWATH, and Mid-Foil watercraft which have recently become of interest to the naval industry. As a result of these studies, the various forms of low drag underwater submerged displacement hulls disclosed herein were developed.

Figure 1:
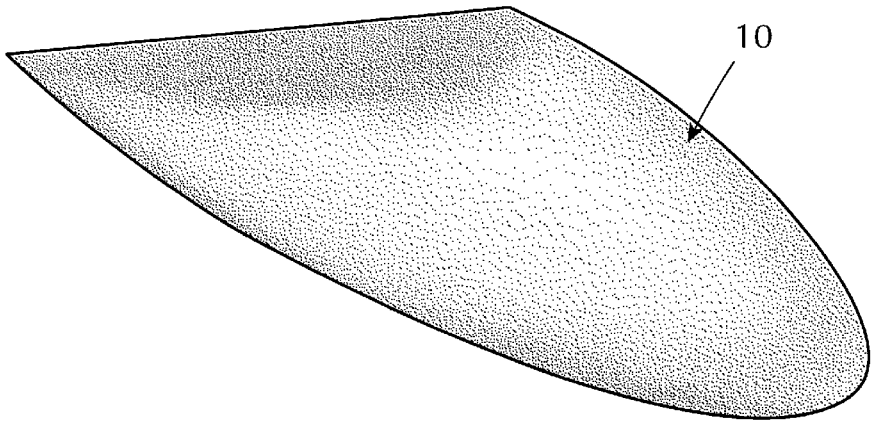
Figure 1A:
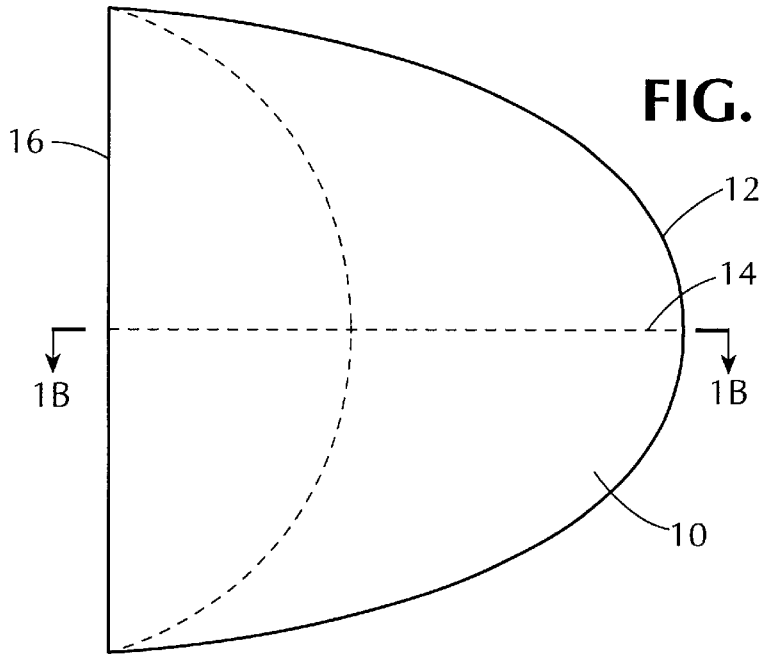
FIG. 1A is a plan view of the embodiment of FIG. 1.

FIG. 1 illustrates the basic hull form 10 of one embodiment of the present invention which contains the basic features of all of the embodiments. In particular, the hull has a parabolic configuration in plan and a generally parabolic foil shape in longitudinal cross-section. This is illustrated more clearly in FIGS. 1A an 1B. As seen in FIG. 1A, hull 10 has a peripheral edge 12, also referred to herein as the leading edge of the hull, which defines the widest portion of the body when viewed in plan. This edge is defined as a parabola substantially conforming to the conventional parabolic equation.

Figure 1B:
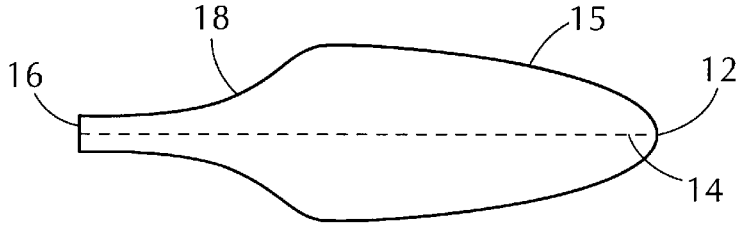
FIG. 1B is a cross-sectional view taken along line 1B—1B of FIG. 1A.

The shape of hull 10 in cross-section is generally that of a parabola 15, as seen in FIG. 1B. The specific shape of the two parabolas 12 and 15 may vary generally as desired according to the size requirements of the vessel, and within certain ranges of length to thickness, and aspect ratios. And, the longitudinal parabolic cross-section may be cambered to improve pressure distribution on the hull surface. The cambering results in deviation of the hull surface from a perfect parabolic curve in cross-section. Cambering can be adjusted and modified based on design operating conditions and speed using a well known two dimensional foil design program named XFOIL created by MIT.

Hull 10 is symmetrical, and longitudinal cross-sections taken parallel to the fore and aft is 14 of the vessel are generally symmetrical to the parabolic foil shape defining the central cross-section shown in FIG. 1B, but the scale of each cross-section decreases generally uniformly away from the fore/aft axis so that the hull tapers towards the edge parabola 12. The vertices of the cross-sectional parabolic foil shapes lie on the peripheral edge 12 defined by the plan parabolic shape of the hull. As described hereinafter, the longitudinal cross-sectional shapes may be canted slightly-fore and aft as required to a desired angle of attack.

Hull 10 also includes a stern or rear edge 16 which, in the illustrative embodiment, is thin and straight. The parabolic foil curve 15 which defines the longitudinal cross-sectional shape of the hull extends from edge 12 towards the stern, as seen in FIG. 1B. However, along each longitudinal cross-section section of the hull, at approximately two-thirds of the length of the hull from the cross-sections' vertex point on edge 12, the hull begins to taper towards the stern in an aft section 18. It has been found that this shape for the hull minimizes pressure drag and precludes cavitation in the speed ranges of operation of the vessels with which such hulls are desirably used.

FIGS. 2 and 3 are perspective views of hulls similar to the hull of FIG. 1, but having a somewhat different thickness to length ratio and aspect ratio. (Aspect ratio as used herein means the span of the hull, i.e. the longest dimension in the direction perpendicular to the water flow, squared, divided by the area of the hull:AR=span$^2$/area.)

The specific shapes and dimensions of the hull structure constructed in accordance with this invention can be used to control pressure recovery and minimize pressure drag. The variations possible in body dimensions allow tailoring of the hull structure and size to specific design needs such as speed, displacement, draft and shallow water.

Figure 9:
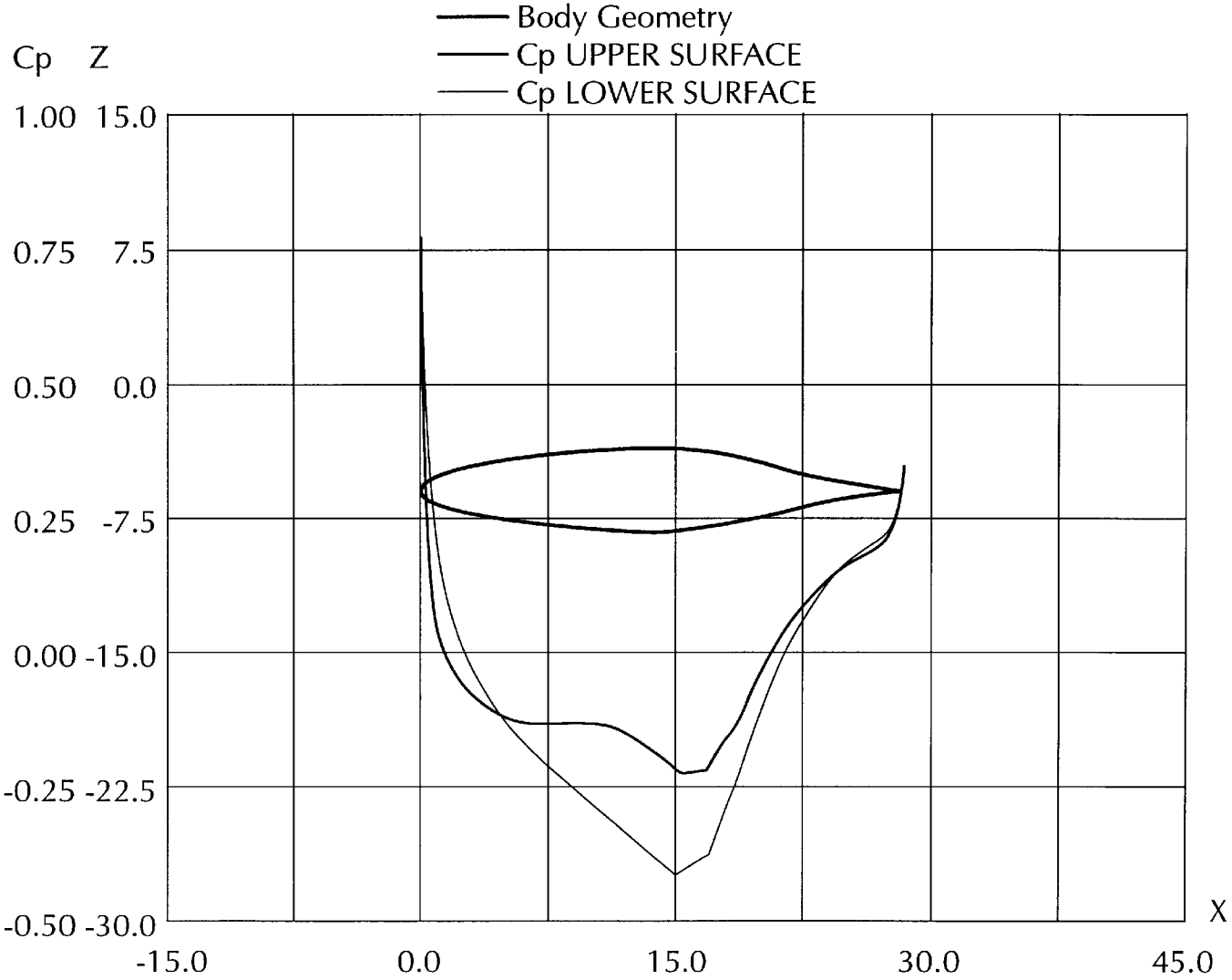
FIGS. 9 and 10 are graphs demonstrating the cavitation pressure on the surfaces of lifting bodies constructed in accordance with the embodiments of FIGS. 1–3.
Figure 11:
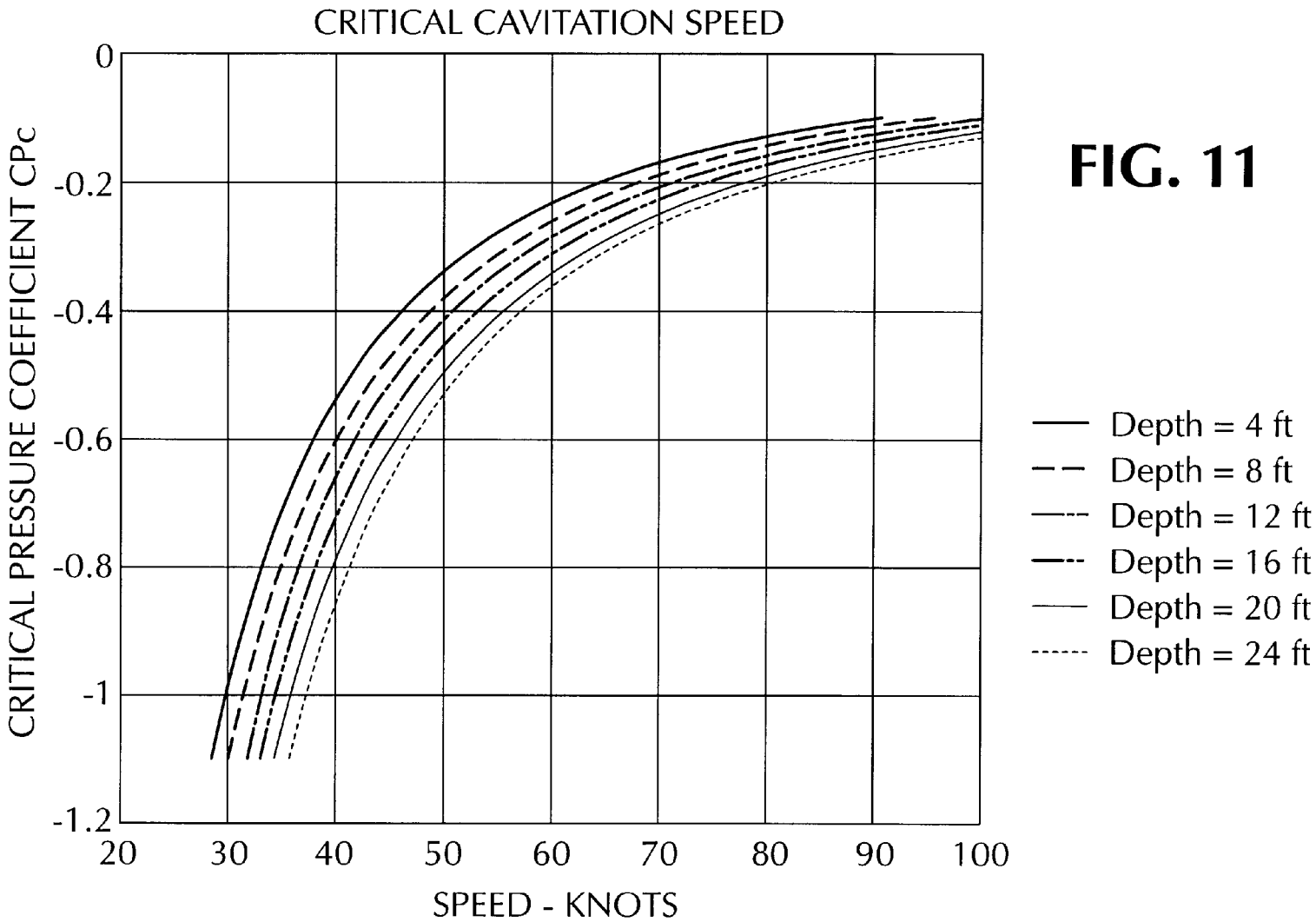
FIG. 11 is a graph of critical cavitation speed versus critical pressure coefficient at various depths.

FIG. 11 shows a conventional graph of critical cavitation speed versus critical pressure coefficients at various speeds and depths. As will be understood by those skilled in the art, this graph demonstrates that desirable operation speeds of up to about 35 knots require cavitation pressures of less than −0.7. It has been found that with the low drag hull bodies of the present invention, the cavitation pressures will be far less than that number on both the upper and lower surfaces of the hull. For example, the graph of FIG. 9 shows cavitation pressure along the surface of both the upper and lower surfaces of the hull of FIG. 1. The minimum cavitation pressures for these bodies are far less than −0.7. Accordingly, cavitation will not occur with these bodies.

The embodiments of FIGS. 1, 2 and 3 have a 17% thickness to length ratio and the following dimensions:

| FIG. | Aspect Ratio | Length | Span | Surface Area |
|---|---|---|---|---|
| 1 | 1.31 | 28.15' | 28.15' | 1317 sq. ft. |
| 2 | .88 | 34.01' | 18.88' | 1140 sq. ft. |
| 3 | .36 | 44.63' | 11.16' | 1044 sq. ft. |

Although these shapes will be subject to some of the known effects of sinkage, this can be overcome by varying the camber and/or angle of attack of the hull form.

Figure 12A:
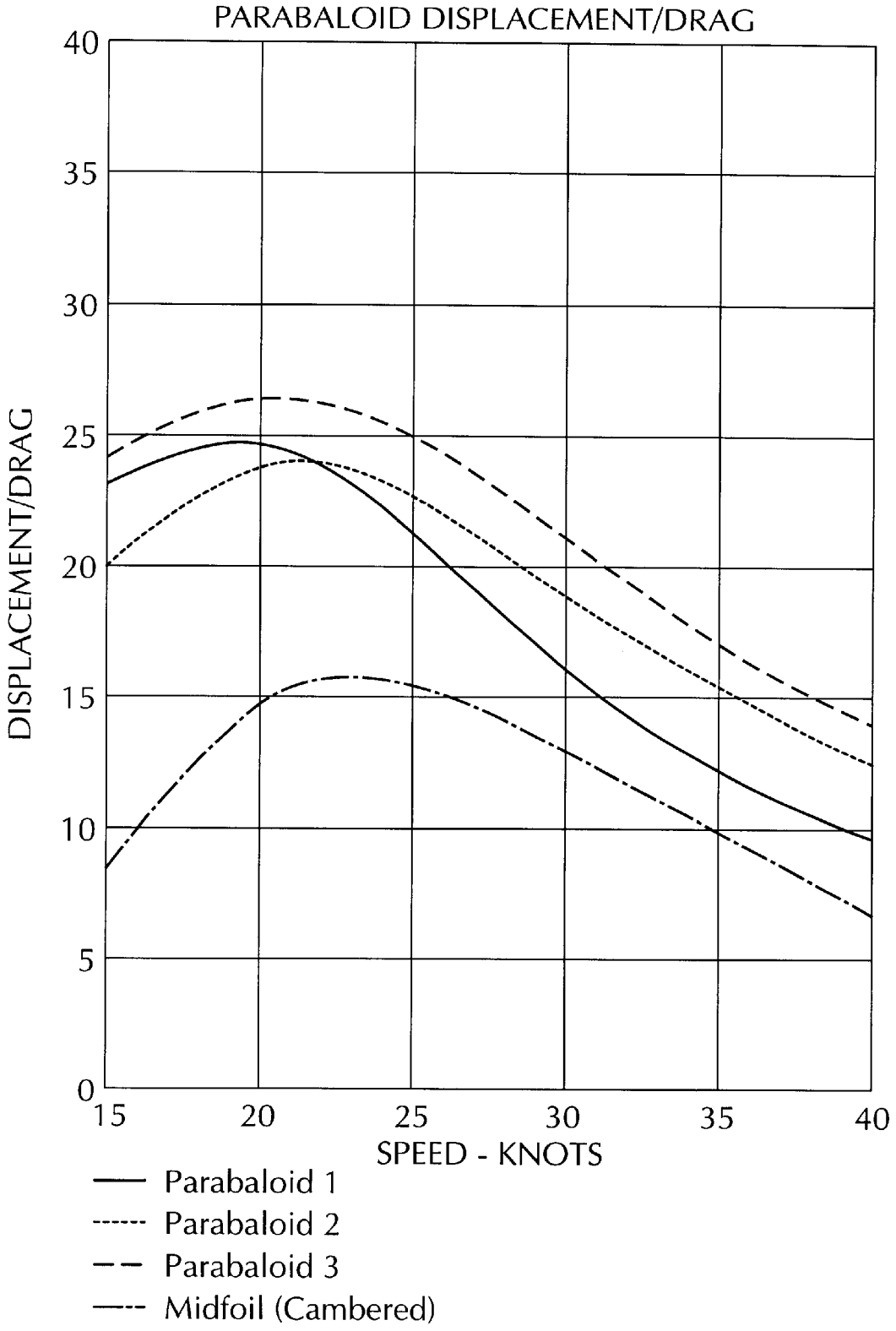
FIG. 12A is a graph of displacement/drag versus hull speed for the hulls of FIGS. 1–3 and a conventional Mid-Foil hull.

FIG. 12A is a graph comparing displacement/drag versus speed for each of the embodiments of FIGS. 1 and 3 to a conventional midfoil foil used in a midfoil SWATH vessel. The solid line represents the curve for the foil of FIG. 1; the long dashed line represents the curve for the hull of FIG. 3; the short dashed represents the curve for the hull of FIG. 2. The dot-dash line represents the curve for a conventional midfoil vessel. As can be seen, the hulls of the present invention perform better than the conventional midfoil vessel and the lower aspect ratio bodies have a better performance than bodies with higher aspect ratios at speeds above 21 knots.

Figure 12B:
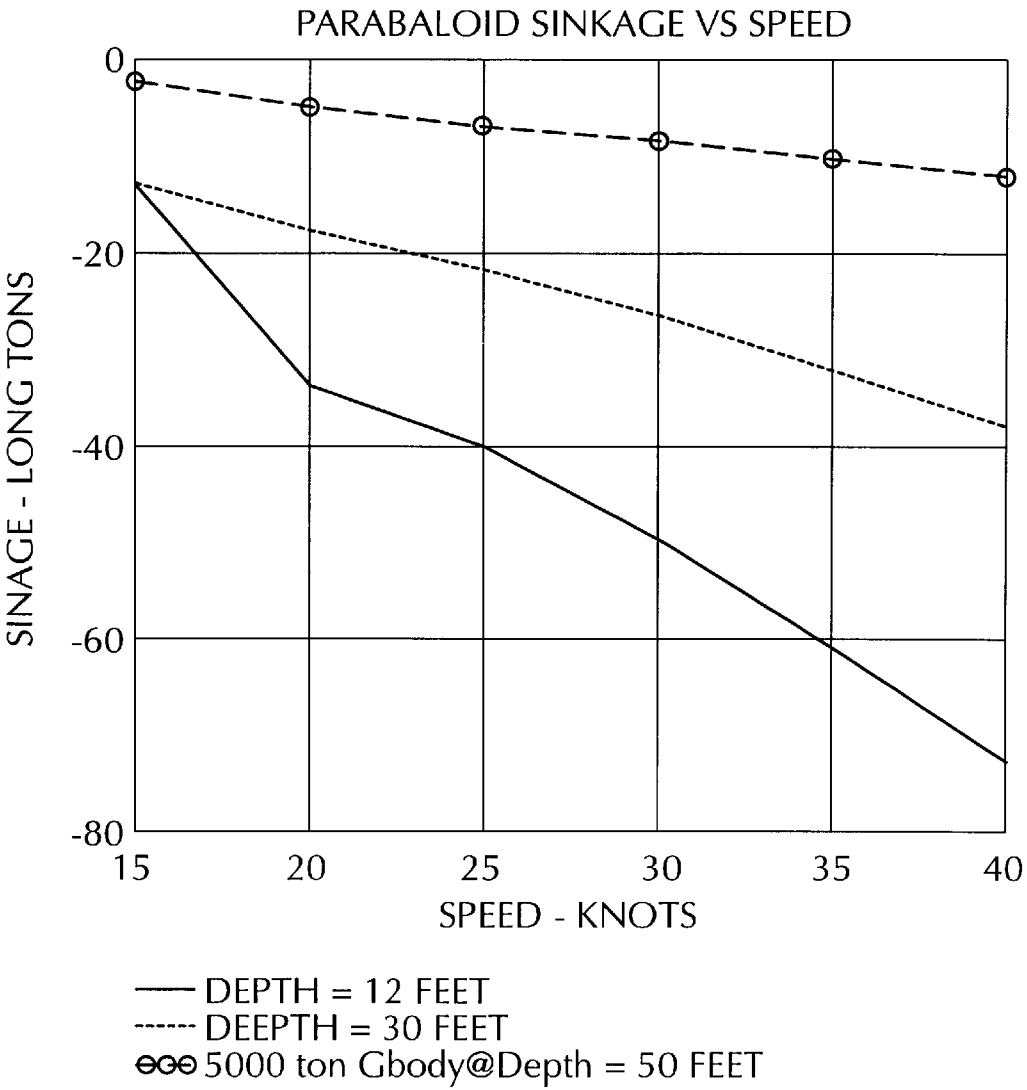
FIG. 12B is a graph of sinkage versus speed for the lifting bodies of FIGS. 1–3.
Figure 13A:
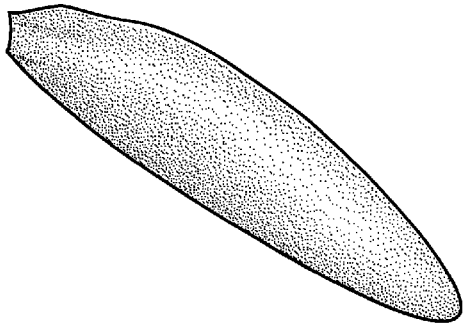
FIGS. 13A–D, 14A–D, and 15A–D are perspective views of lifting bodies similar to those shown in FIGS. 1–3, having a different stern configuration and varying thickness to length and aspect ratios.
Figure 13B:
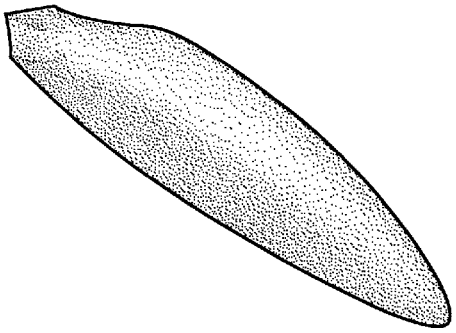
Figure 13C:
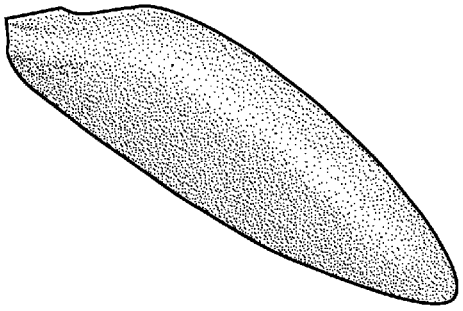
Figure 13D:
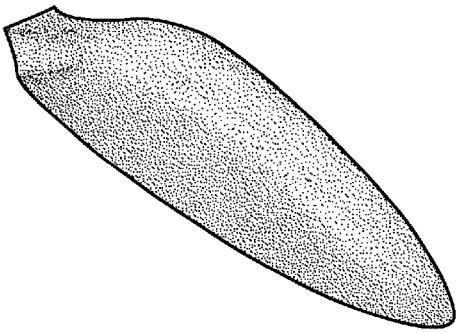
Figure 14A:
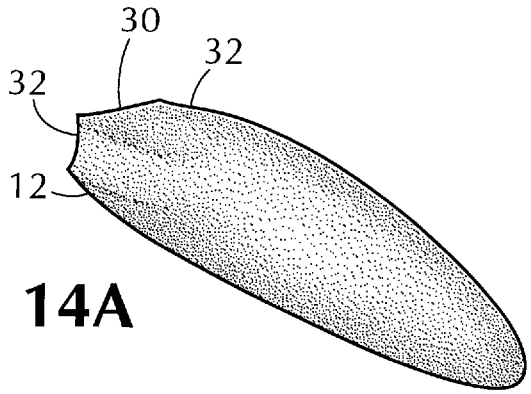
Figure 14B:
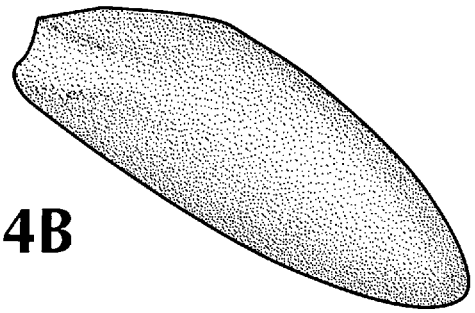
Figure 14C:
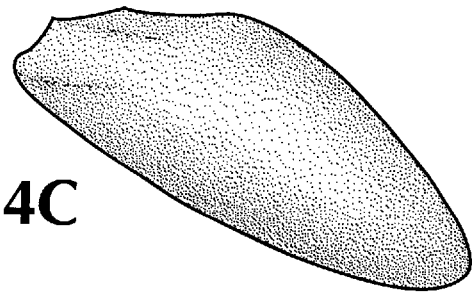
Figure 14D:
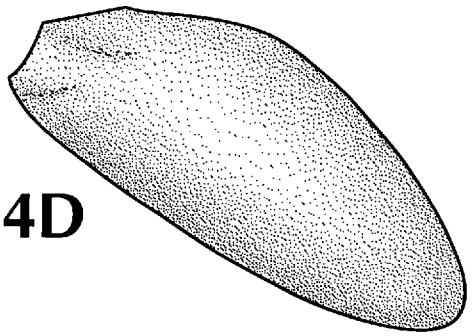
Figure 15A:
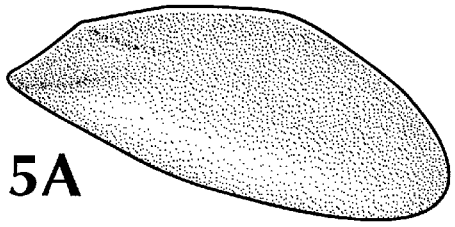
Figure 15B:
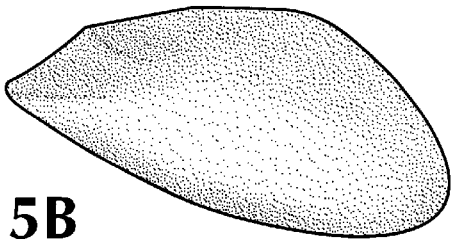
Figure 15C:
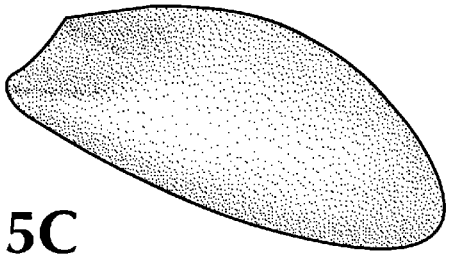
Figure 15D:
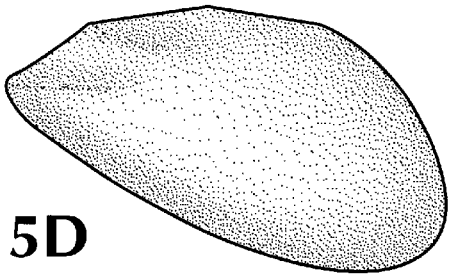
Figure 16A:
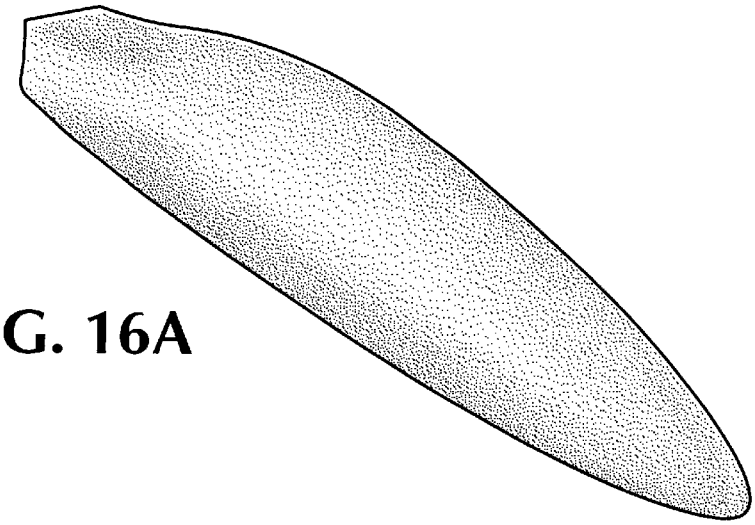
FIG. 16A is an enlarged perspective view of the embodiment illustrated in FIG. 13A.
Figure 16B:
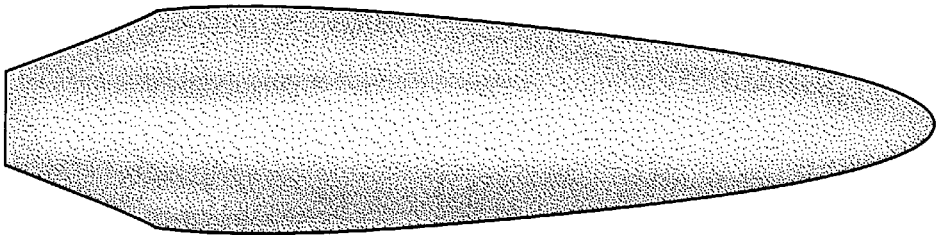
FIG. 16B is a top plan view of the embodiment of FIG. 16A.
Figure 16C:
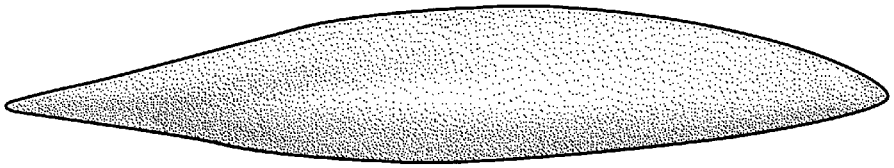
FIG. 16C is a side view of the embodiment of FIG. 13A.
Figure 16D:
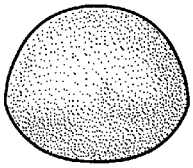
FIG. 16D is a front view of the embodiment of FIG. 13A.
Figure 17A:
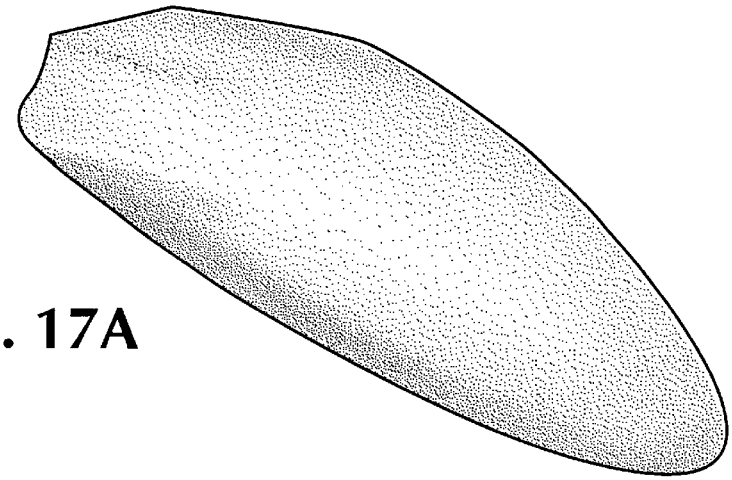
FIGS. 17A–17D are similar to FIGS. 16A–16D for the embodiment of FIG. 14B.
Figure 17B:
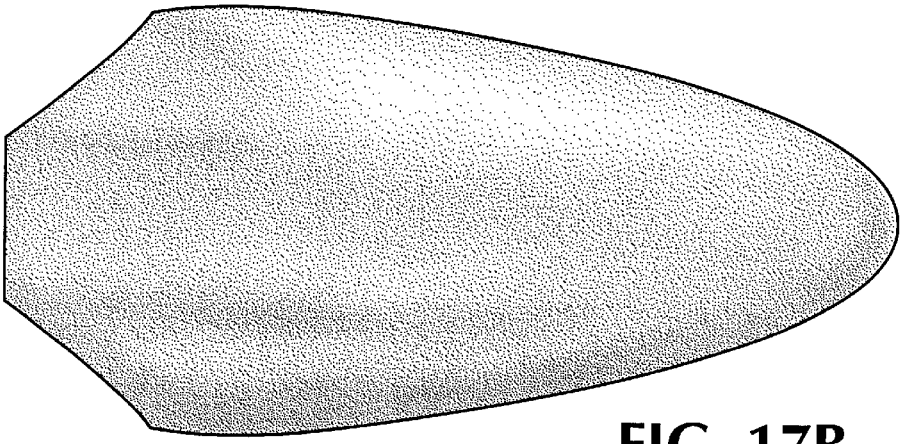
Figure 17C:
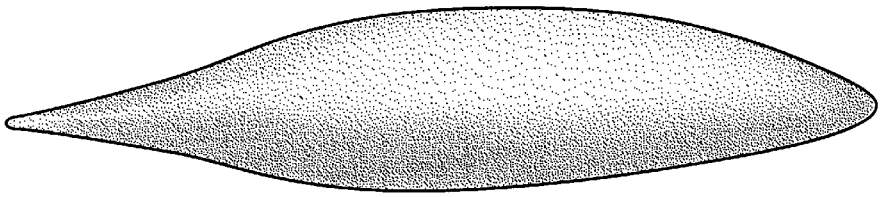
Figure 17D:
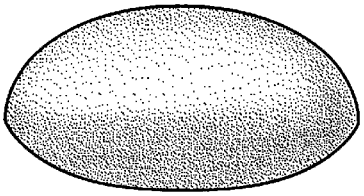
Figure 18A:
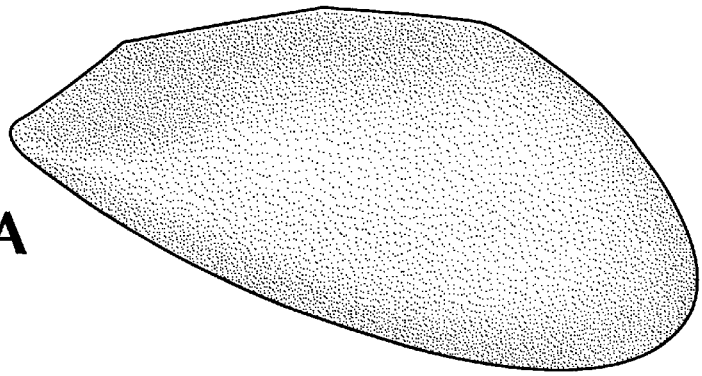
FIGS. 18A–18D are similar to FIGS. 16A–16D but for the embodiment of FIG. 15C.
Figure 18B:
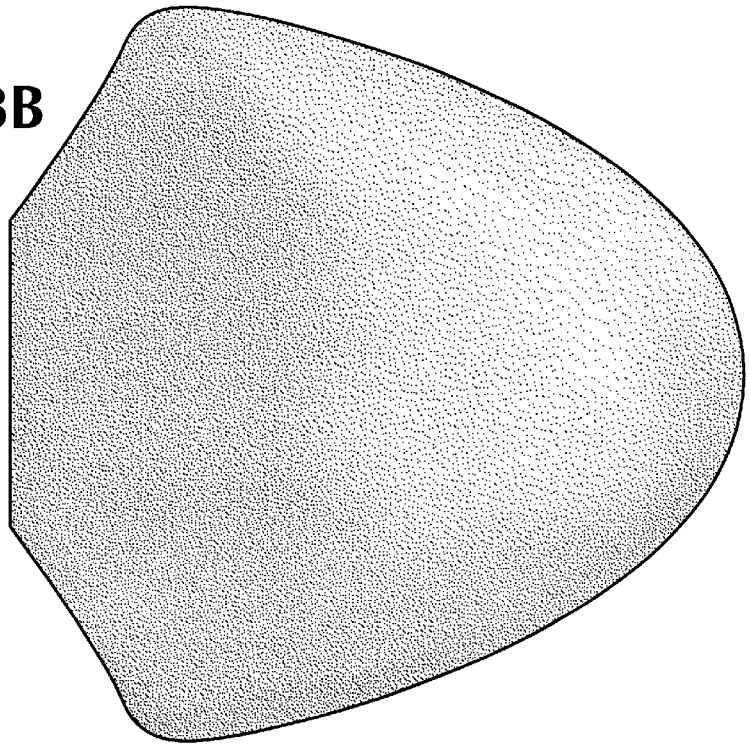
Figure 18C:
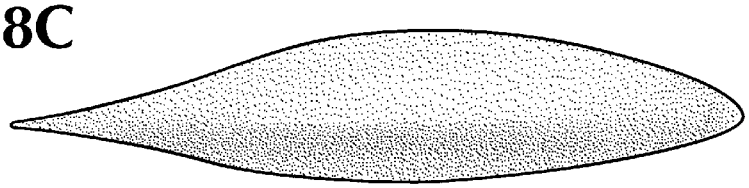
Figure 18D:
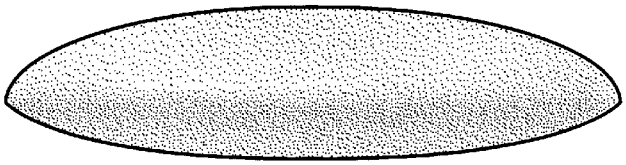
Figure 19A:
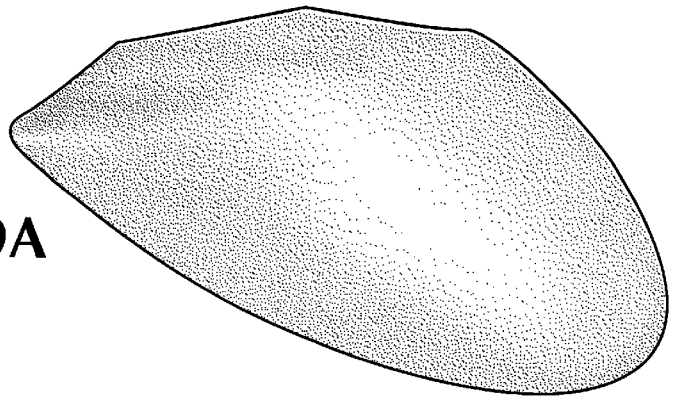
FIGS. 19A–19D are similar to FIGS. 16A–16D but for the embodiment of FIG. 15D.
Figure 19B:
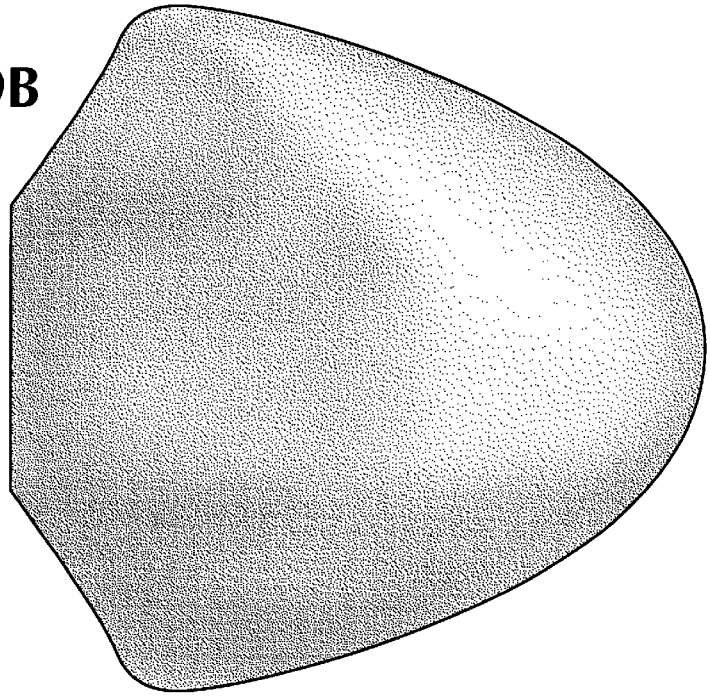
Figure 19C:
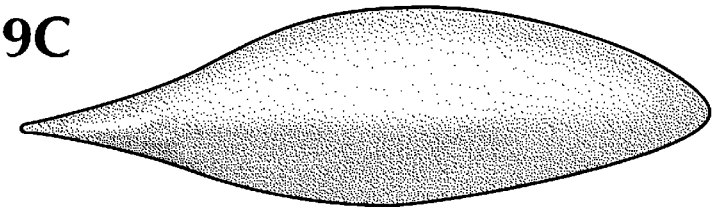
Figure 19D:
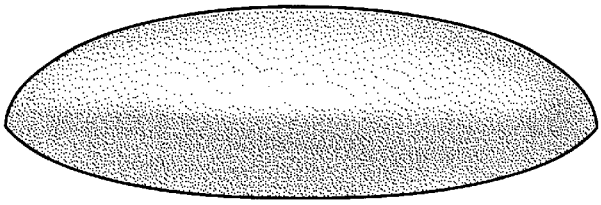
Figure 21A:
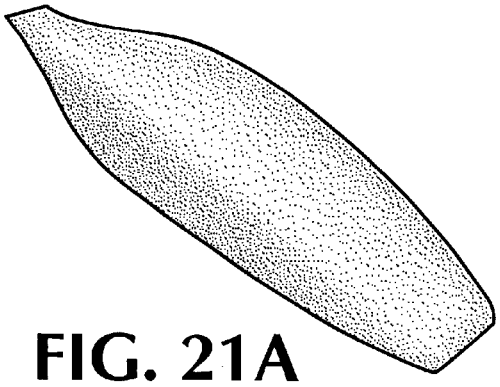
FIGS. 21A–21C.
Figure 21B:
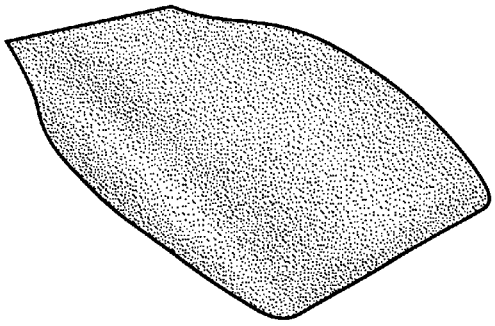
Figure 21C:
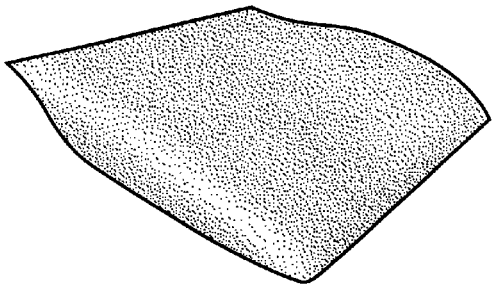

FIG. 12B compares sinkage for each of the three embodiments of FIGS. 1–3 versus speed. As can be seen therein, the higher aspect ratio body of FIG. 1 has a greater sinkage rate at speed than the other lower aspect ratio hulls but, as noted above, sinkage can be overcome with these hulls by adjusting camber and/or angle of attack.

Figure 4:
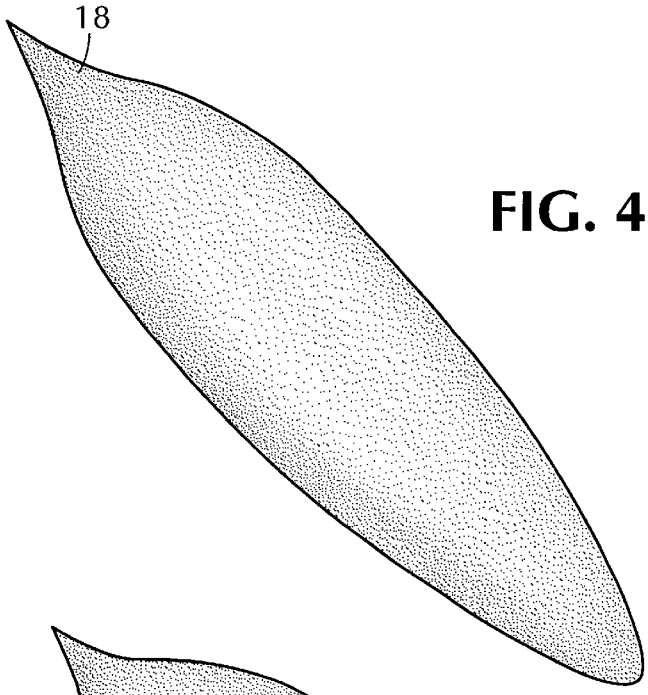
FIGS. 4, 5 and 6 are perspective views of three forms of a second embodiment of low drag underwater submerged displacement hull constructed in accordance with the present invention.
Figure 5:
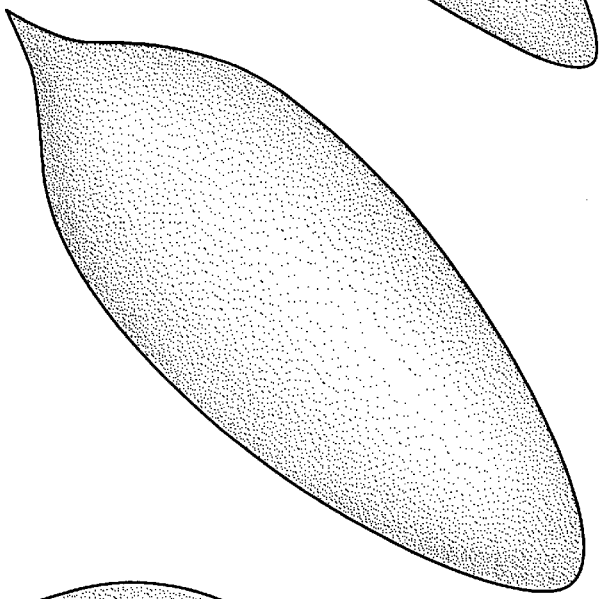
Figure 6:
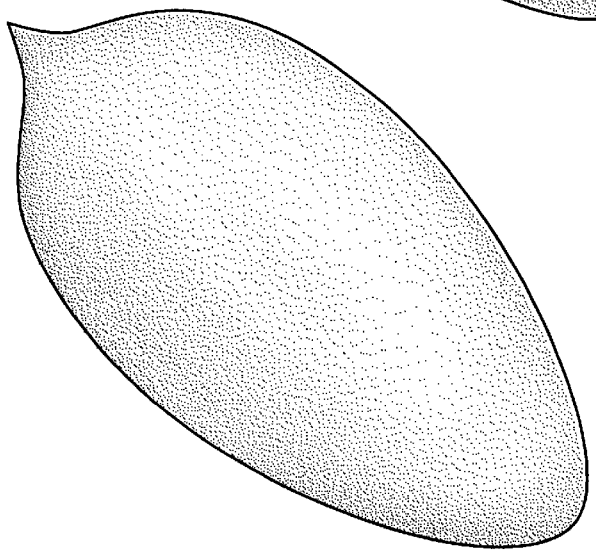

FIGS. 4, 5 and 6 show another embodiment of the lifting body of the present invention also formed by parabolic curves. In these embodiments the hulls are each formed as a body of revolution from a single parabola. However, as will be understood by those skilled in the art, when the hull is viewed in plan, it has a midpoint leading edge, similar to the edge 12 of the FIG. 1 embodiment which is defined about its equator and is in the shape of the same parabola. In addition, cross-sectional views of the hull parallel to the longitudinal axis of the hull will have a parabolic form with the leading edge of each parabola being on the midline parabolic curve 12. As with the embodiment of FIGS. 1–3, the aft section 18 of the hull is tapered towards the stern.

The hulls illustrated in FIGS. 4–6 are dimensioned as follows:

| FIG. | Thickness Ratio | Length | Diameter/Span | Surface Area |
|---|---|---|---|---|
| 4 | 17/% | 51.98' | 8.84' | 921 sq. ft. |
| 5 | 25% | 40.15' | 10.04' | 819 sq. ft. |
| 6 | 33% | 32.65' | 10.87' | 739 sq. ft. |

Figure 10:
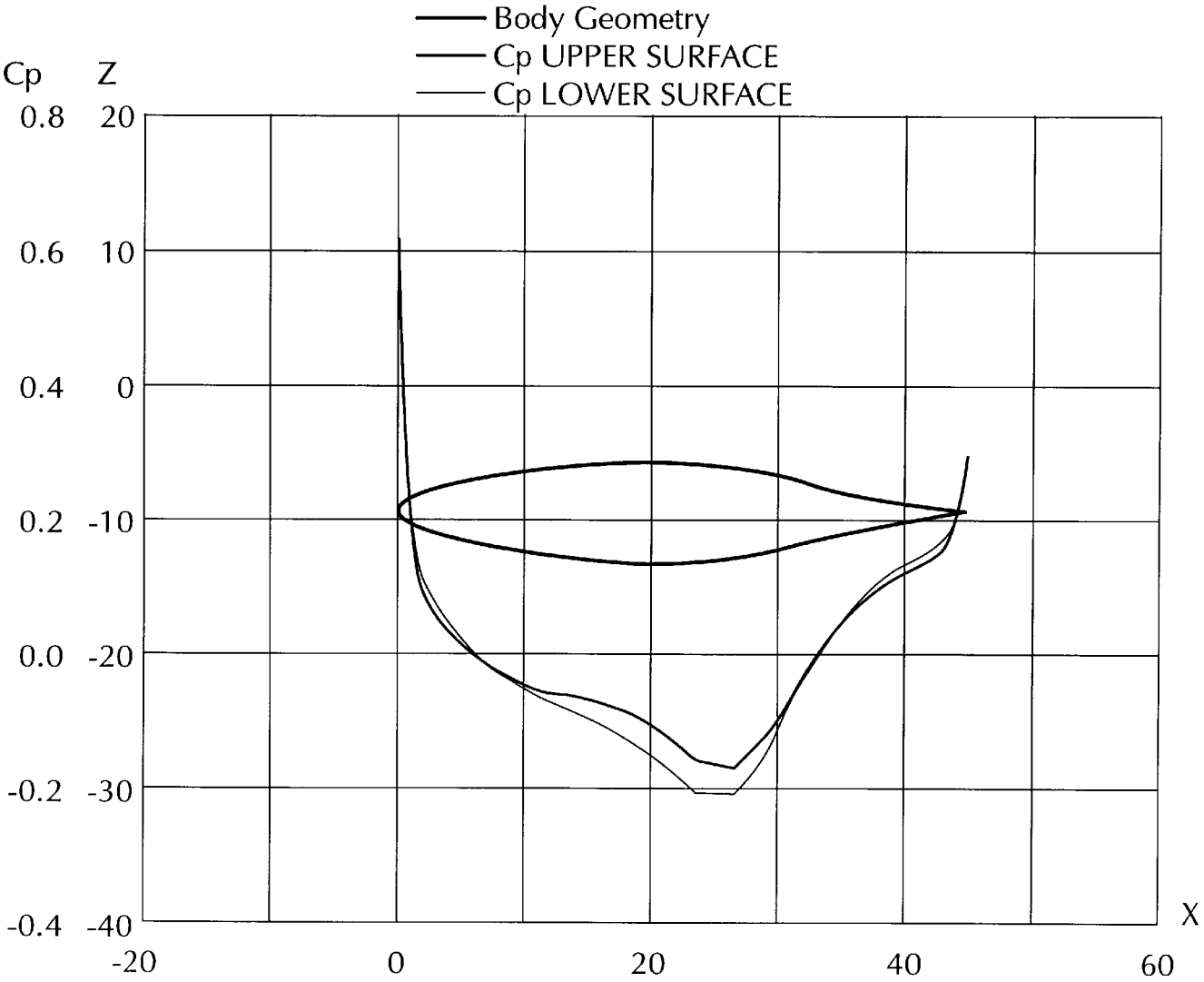

Cavitation occurs when pressures on the body surface are less than the vapor pressure of water. Measurements similar to those discussed above with respect to FIGS. 9 and 10 for these hulls also demonstrate that for these hulls the minimum critical pressures are −0.18, −0.31 and −0.46, substantially above the critical pressure of −0.7 as discussed above. Therefore, again with these hulls, cavitation will not occur. Measurements also demonstrate that the displacement to drag values of the hulls of this embodiment are superior to those of a convention midfoil body.

As will be understood by those skilled in the art, watercraft stability is a function of the waterline hull design as well as the design of the submerged hull. For example, in both midfoil and certain SWAS vessels, buoyancy and stability is provided at the corners of the vessel and thus a stable platform is provided. However, when a craft is underway, stability is also a function of the control surfaces used for motion control. Thus, the hulls of the present invention may also include control surfaces thereon depending in size and number on the configuration of the vessel in which it is used and the location of the surfaces. These control surfaces can include trim tabs, fins, pods, and the like as necessary.

Applicant has found that the foil-shaped bodies formed from parabolic curves and the parabolically-shaped pods of FIGS. 1–6 provide higher displacement drag ratios relative to conventional foil and pod bodies and they can operate essentially without cavitation.

Figure 7:
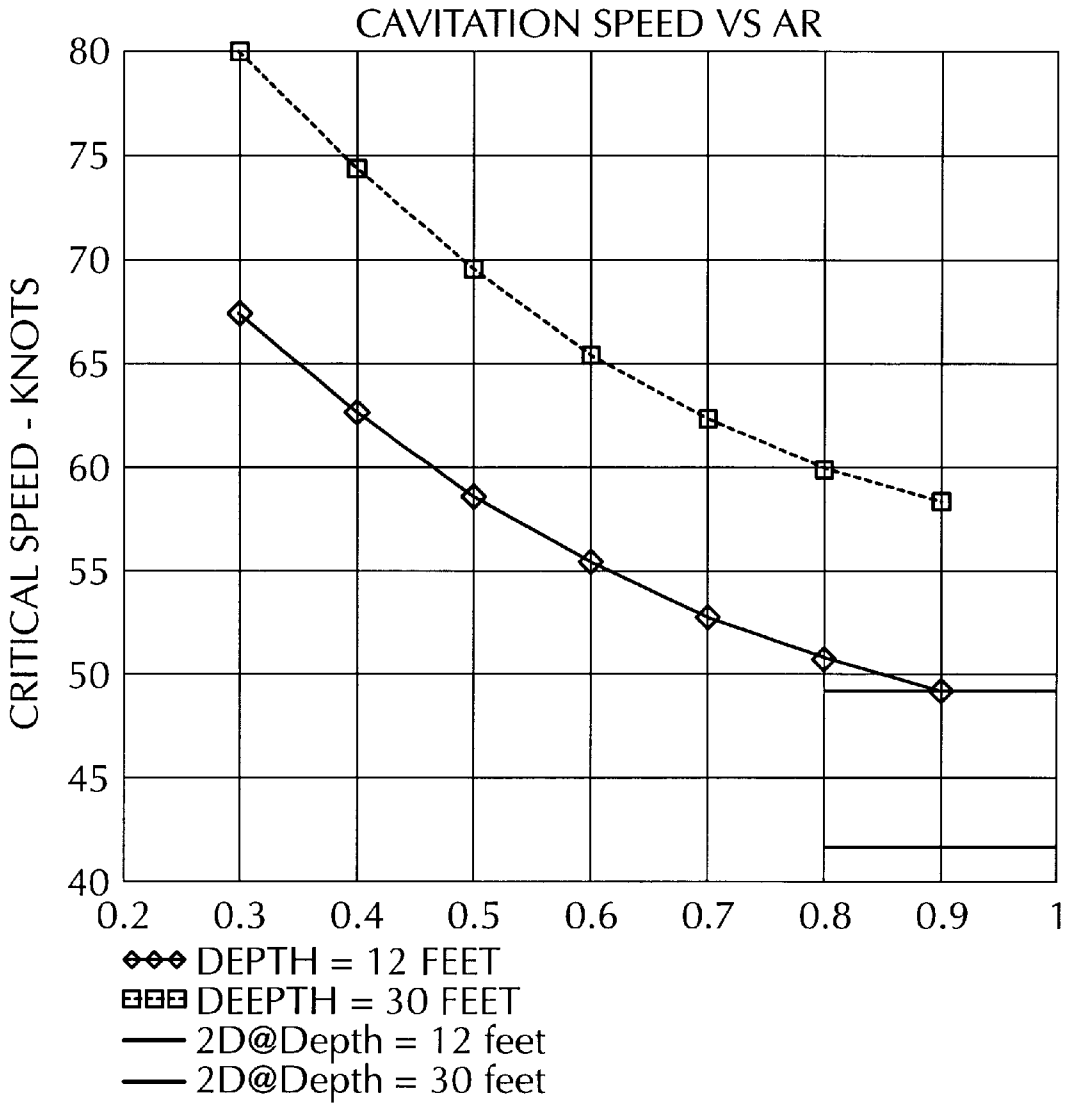
FIG. 7 is a graph showing the relationship of cavitation speed to critical speed at two different water depths.
Figure 8:
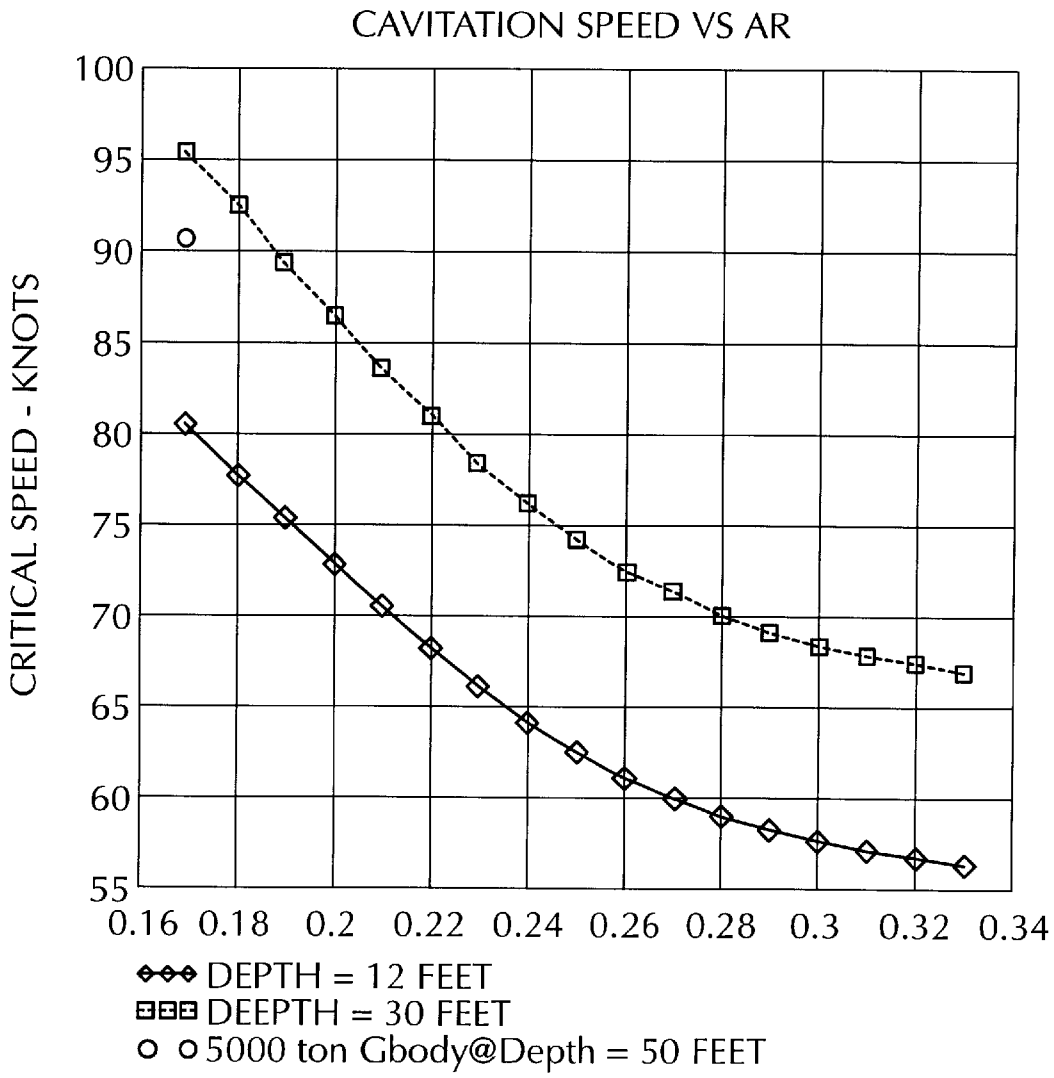
FIG. 8 is a graph of cavitation speed versus thickness ratios for the lifting bodies of the embodiment of FIGS. 1–3.

FIG. 7 illustrates a conventional graph showing cavitation speed versus aspect ratio while FIG. 8 is a graph of cavitation speed versus thickness ratio for the hulls constructed in accordance with the present invention. As seen in FIG. 7 as the aspect ratio increases and the body approaches a two-dimensional shape, cavitation speed decreases. Different depth settings are shown, and as will be understood by those skilled in the art, the two curves will asymptotically approach the two-dimensional limit lines for those depths. From the curve it can be seen that an 80 knot capability can be achieved with hull shapes having a 0.3 aspect ratio body at a depth of 30 feet. On the other hand, from FIG. 8, it can be seen that a hull made according to the present invention having a 17% thickness ratio operating at 30 feet has a critical cavitation speed of 95 knots, while a hull having a thickness ratio of 33% at a 30 foot depth has a critical speed of 66 knots. These represent substantially improved operating conditions over the prior art.

FIGS. 13A–15D show various forms of another embodiment of the foil hull of the present invention. In this case, the hull is formed similarly to that described with respect to FIGS. 1–3, i.e., with a peripheral parabolic plan footprint that defines a leading edge with the main body shape in the longitudinal direction having longitudinal parabolic foil cross-sections which are also symmetrical parallel to the fore and aft axis of the hull and with the tip or a vertex of each parabolic cross-section starting on the plan parabola. In lieu of a straight stern, these hulls have a midship straight stern section 30 and fared concave sections 32 between the opposed ends of straight stern section 30 conditions and speed using the well known X-Foil™ two-dimensional foil design program created by the Massachusetts Institute of Technology the possibility of cavitation at the junction of the stern and the parabolic plan edge of the hull.

Each of the FIGS. 13–15 illustrates proportionately the thickness to length ratio and aspect ratio of the particular hull illustrated. However, the specific dimensions of the hulls illustrated in the drawings and which were tested in the development of this invention, are as follows:

TABLE 1

Body Geometries

| FIG. | Thickness | AR | Length (ft) | Thick (ft) | Span (ft) | Wetted Area (ft ^ 2) |
|---|---|---|---|---|---|---|
| 13A | 0.17 | 0.33 | 47.32 | 8.04 | 11.7 | 1074.87 |
| 14A | 0.17 | 0.66 | 37.56 | 6.39 | 18.57 | 1164.94 |
| 15A | 0.17 | 1.32 | 29.81 | 5.07 | 29.47 | 1382.99 |
| 13B | 0.21 | 0.33 | 44.03 | 9.25 | 10.88 | 1008.47 |
| 14B | 0.21 | 0.66 | 34.95 | 7.34 | 17.27 | 1050.79 |
| 15B | 0.21 | 1.32 | 27.74 | 5.83 | 27.42 | 1222.68 |
| 13C | 0.25 | 0.33 | 41.59 | 10.40 | 10.28 | 971.02 |
| 14C | 0.25 | 0.66 | 33.01 | 8.25 | 16.32 | 978.10 |
| 14C | 0.25 | 1.32 | 26.20 | 6.55 | 25.91 | 1116.59 |
| 13D | 0.29 | 0.33 | 39.61 | 11.49 | 9.79 | 948.46 |
| 14D | 0.29 | 0.66 | 31.43 | 9.11 | 15.54 | 926.11 |
| 15D | 0.29 | 1.32 | 24.95 | 7.24 | 24.67 | 1037.95 |

As discussed above in the description of the drawings, certain of the hull forms of FIGS. 13–15 are illustrated in greater detail in FIGS. 16 through 19. Each of these bodies was designed with a slight camber of 2% and an angle of attack of 1°. It has been found that with these hull shapes, the displacement to drag ratio increases as the thickness ratio increases and that for thickness/length ratios of 0.17, performance improves with decreasing aspect ratio while at thickness ratios of 0.29 the largest aspect ratio bodies have the best performance. Accordingly, depending upon the use to which the hull is to be put and the size and shape requirements, the hull should have a thickness ratio generally within this range.

FIGS. 20A–D illustrate another embodiment of the invention which is in accordance with the same principles previously described with respect to the embodiment of FIGS. 1–3. Here the difference is the stern 40 is formed as yet a third parabolic curve (in plan) which is fared at its end into the leading edge parabolic curve 12 of the hull. It has been found that this configuration further reduces the possibility of the formation of cavitation at the point of junction between the stern and the leading edge.

FIGS. 21A–C through 24A and B disclose several forms of yet another embodiment of the invention based on the same principles. In this case, each hull illustrated in these Figures has a different thickness and aspect ratio as noted. The hulls are formed in principle by designing a parabolic pod-type structure in accordance with the present invention, such as shown in FIGS. 4 and 5, and then dividing the pod in half along its longitudinal axis. The pods halves are then spaced apart a desired width and the central or longitudinal midships portion of the hull is formed with uniform parabolic cross-sections complementary to the parabolic longitudinal cross-section of the original pod shape. Thus, the hull is formed with parabolic longitudinal cross-sections across its width, but it also has a parabolic peripheral leading edge in plan, except for the bow which, in plan, includes a midhull straight section. The aft section of the hull is tapered, as described above, from about two-thirds of the length of the hull to the stern.

The specific dimensions for the hulls illustrated in FIGS. 21–24 are shown in Table 2 as follows:

TABLE 2

Body Geometries

| FIG. | Thickness | AR | Length (ft) | Thick (ft) | Span (ft) | SREF (ft ^ ) | Factor | Wetted Area (ft ^ 2) | Depth (ft) |
|---|---|---|---|---|---|---|---|---|---|
| 21A | 0.17 | 0.33 | 44.98 | 7.65 | 11.21 | 380.57 | 2.653 | 1009.65 | 13.38 |
| 21B | 0.17 | 0.66 | 31.50 | 5.36 | 18.65 | 527.04 | 2.262 | 1192.16 | 9.37 |
| 21C | 0.17 | 1.32 | 23.97 | 4.07 | 30.1 | 686.53 | 2.142 | 1470.55 | 7.13 |
| 22A | 0.21 | 0.66 | 30.04 | 6.31 | 17.17 | 446.93 | 2.375 | 1061.46 | 11.04 |
| 22B | 0.21 | 1.32 | 22.52 | 4.73 | 27.89 | 589.29 | 2.192 | 1291.72 | 8.28 |
| 23A | 0.25 | 0.66 | 29.19 | 7.30 | 16.01 | 388.48 | 2.472 | 960.32 | 12.77 |
| 23B | 0.25 | 1.32 | 21.49 | 5.37 | 26.22 | 520.69 | 2.247 | 1169.99 | 9.40 |
| 24A | 0.29 | 0.29 | 28.63 | 8.3027 | 15.09 | 344.96 | 2.591 | 893.79 | 14.53 |
| 24B | 0.29 | 0.29 | 20.67 | 5.9943 | 24.88 | 468.87 | 2.301 | 1078.87 | 10.49 |

Figure 22A:
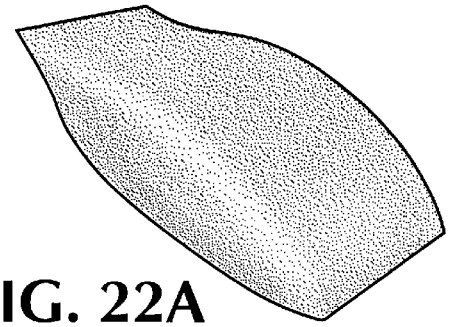
FIGS. 22A & B.
Figure 22B:
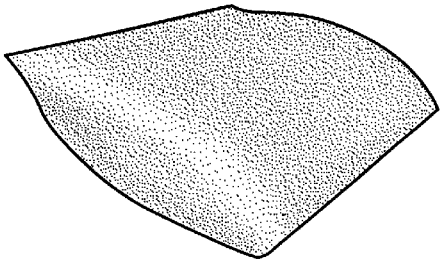
Figure 23A:
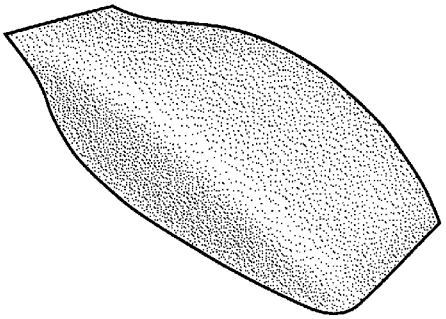
FIGS. 23A & B; and 24A& B; are perspective views of various forms of another embodiment of the foil-shaped lifting body of the present invention.
Figure 23B:
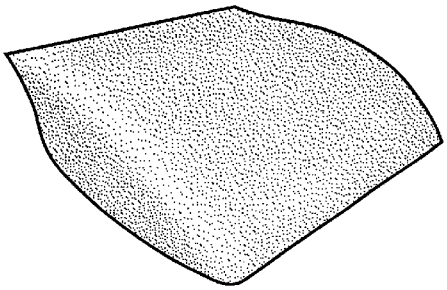
Figure 24A:
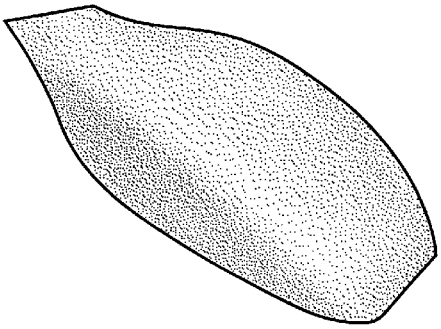
Figure 24B:
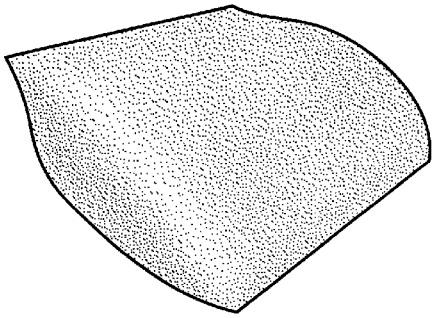
Figure 25A:
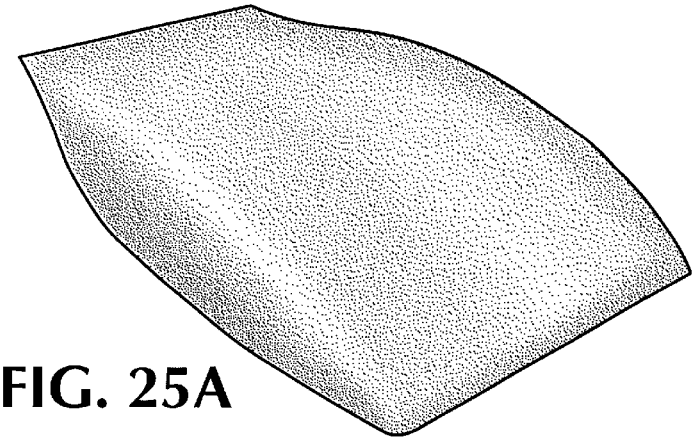
FIGS. 25A–D are similar to FIGS. 16A–16D but for the embodiment of FIG. 21B.
Figure 25B:
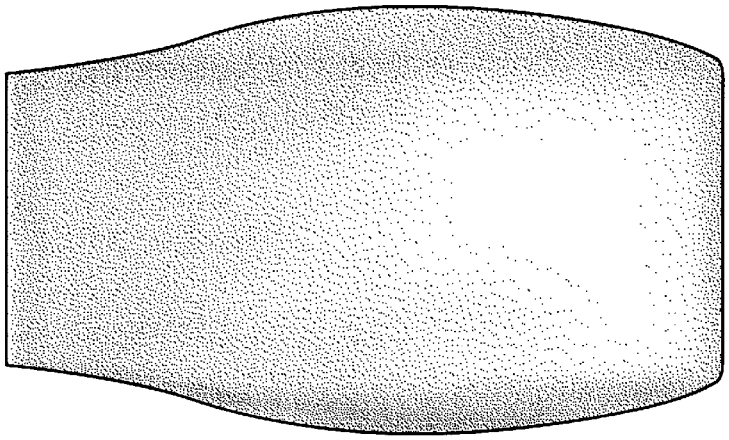
Figure 25C:
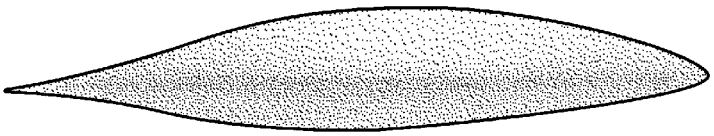
Figure 25D:
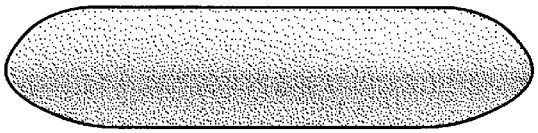

As also described above, FIGS. 25 through 27 are enlarged illustrations of certain of the embodiments of FIGS. 21–23 to aid in the understanding of their configuration.

These hulls also have substantially improved performance compared to prior submerged hulls used in SWAS or midfoil vessels. It has been found that the bodies of these embodiments are capable of cavitation-free operations at 35 knots and below. Localized cavitation such as discussed above may occur at the corners of the stern, however these corners may be modified slightly to eliminate such cavitation. It has also been found that pressure distribution along the surfaces of these bodies does not vary significantly over their optimal speed range. In general, the thicker bodies made in accordance with the present invention have better displacement/drag ratios than the thinner bodies. Thus, for a specific application, bodies with the highest thickness ratio should be used which satisfy other design considerations such as speed, cavitation and draft. The flow over the bodies is well-behaved, there are no indications of separation, and cavitation is not a significant problem. As also noted above, these bodies have low-pressure gradients over their surfaces, making them less sensitive to changes in the body angle of attack relative to flow and thus less sensitive to free surface disturbances. They produce less frictional drag because of less wetted surface area, require less structural weight and less cost. Furthermore, high displacements can be achieved with relatively short bodies allowing the bodies to operate at Froude numbers in excess of 1 which results in less wavemaking, and less friction drag from a thinner boundary layer.

The shapes of the hull bodies of the present invention are very uniform, resulting in minimal disturbance beyond the trailing edge through appendages, bodies or propulsers positioned behind them. These bodies, when used in vessels such as midfoil and other SWATH or SWAS vessels, displace the free surface in a manner which reduces the pressure coefficient on the body, allowing higher incipient cavitation speeds. Their dynamic lift can be varied as a function of camber, submergence, speed and angle of attack to optimize the lift characteristics for a given craft design speed. For motion control and stabilization, the dynamic lift of the bodies can be varied by the use of integrated trailing edge flaps.

In their simplest form, the hulls of the present invention can be used independently of another vessel and form the entire vessel itself. Applicant has found that even with a high degree of cambering, at a constant draft, these foil structures will experience sinkage forces as they accelerate up to a critical speed. However, after that speed, the result is a net lifting force which will cause the foil to rise. Ultimately, the hull reaches a steady state design speed and a specific immersion depth wherein the sinkage and lift forces are in equilibrium. In effect the hull forms a self submerging vessel from its surface floating state at a specific design depth. At that point the hull is at an exceptionally stable depth and speed which is referred to by applicant as submergence lock. Because there are many combinations of speed and depth where the body achieves submergence lock, the use of the body is very flexible. However, at a specific critical speed where the sinkage force is the greatest, the body will have the deepest draft since at speeds above the critical speed the body will begin to generate dynamic lift and the body will rise to a shallower draft to seek a new equilibrium of the forces acting on it. As a result of this phenomena, the hulls of the present invention can be dimensioned to achieve submergence lock at chosen design speeds and draft. This can result in completely new kinds of vessels such as an unmanned submersible meant to operate as a high speed trailer behind any ship. Another would be as an independent submersible having its own power. Yet another variant would be as a self-powered submerged vessel with a surface piercing strut and small superstructure. The superstructure, for example, could house a diesel electric propulsion system and whatever else is required above the surface, while the submerged body would house the power train and payload.

In addition to the use of the foil shaped hulls of the present invention on SWATH or SWAS vessels, or as independent vessels, these hulls provide advantages to more conventional ship structures. For example, they can be suspended from the hulls of partial hydrofoils monohulls and the like. Mounting one of these hulls to the hull of a conventional vessel provides addition buoyancy to the vessel's hull reducing its lift to drug ratio and reducing load on the hull. Preferably the parabolic foil submerged hull of the invention is attached by a strut or the like to the conventional hulled vessel below its center of gravity. This provides a more efficient way of carrying increased lift for the vessel.

Figure 32:
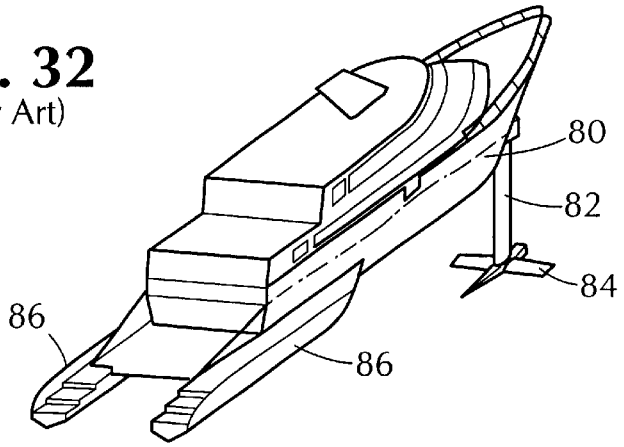
FIG. 32 (Prior Art)
FIG. 32 is a schematic perspective view of a partial hydrofoil vessel having rear pontoons.

FIG. 32 is a perspective view of a conventional partial hydrofoil 80 which has a bow-mounted strut 82 on which a conventional hydrofoil 84 is supported. The aft section of the vessel includes a pair of spaced catamaran-like pontoons 86. In normal operation of this conventional vessel, when the vessel reaches a hydroplaning speed, it is supported solely on the hydrofoil 84 and the pontoons 86. In accordance with the present invention, as seen in FIG. 33, additional buoyancy can be achieved by providing a strut 88 in the aft section of the vessel along with a submerged foil 90 constructed in accordance with any one of the embodiments of the invention disclosed herein. The foil provides additional hydrostatic lift to the vessel raising more of it out of the water (or allowing it to carry greater loads) with resulting reduction in lift to drag ratios. Since the lifting body is below the keel of the vessel, it may be desirable to provide the strut 88 as a vertically retractable element to raise the lifting body within the hull for shallow draft situations. Another hull body with which the foil 90 could be used is the composite mono-hull-catamaran vessel of U.S. Pat. No. 5,038,696.

FIGS. 34–36 illustrate additional conventional hull structures to which a low drag submerged displacement hull in accordance with the present invention can be appended to improve the operation of the vessel by reducing drag and/or the need for excessive power. With these arrangements, at design speed a substantial portion of the craft hull will rise out of the water and be supported by the dynamic lift of the bow hydrofoil and the hydrodynamic lift provide by the submerged hulls of the present invention. The arrangement reduces the critical takeoff speed of these vessels and allows stable low speed flight in hydrofoil mode. Moreover, the presence of the submerged hull improves seakeeping throughout the speed range and improves propulsive efficiency. By providing a retractable hull, the craft can maintain shallow draft capability. Furthermore because conventional ships provided with submerged hulls in accordance with the present invention will have improved lift to drag throughout the speed range, they can carry a greater payload, have a greater speed, and/or be operated with reduced power. Preferably, the submerged hulls of the present invention, when used in this environment, are designed to provide dynamic lift at design speed which is about 30 to 40% of the craft's displacement.

A further advantage the submerged hull of FIG. 33 is that it can house integrated propulsion, i.e., a propeller, water jet or other equipment, sensors and tankage, i.e., fuel, water or ballast. As mentioned above the submerged bodies of the present invention can have control surfaces appended to them, such as trailing edge flaps, and the like.

FIGS. 28–31 illustrate a further feature of the present invention in connection with the submersible pod hull embodiment of the invention. However, the features disclosed in these drawings may also be adapted for use with the parabolic foil hulls.

Figure 28:
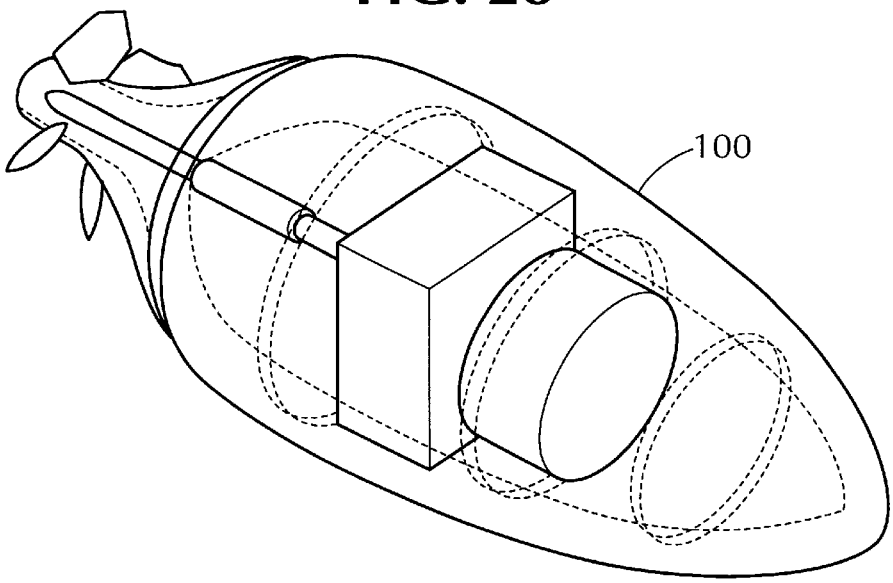
FIG. 28 is a perspective view of a lifting body similar to FIGS. 4 and 5 including a boundary surface area water intake to aid in propulsion.
Figure 29:
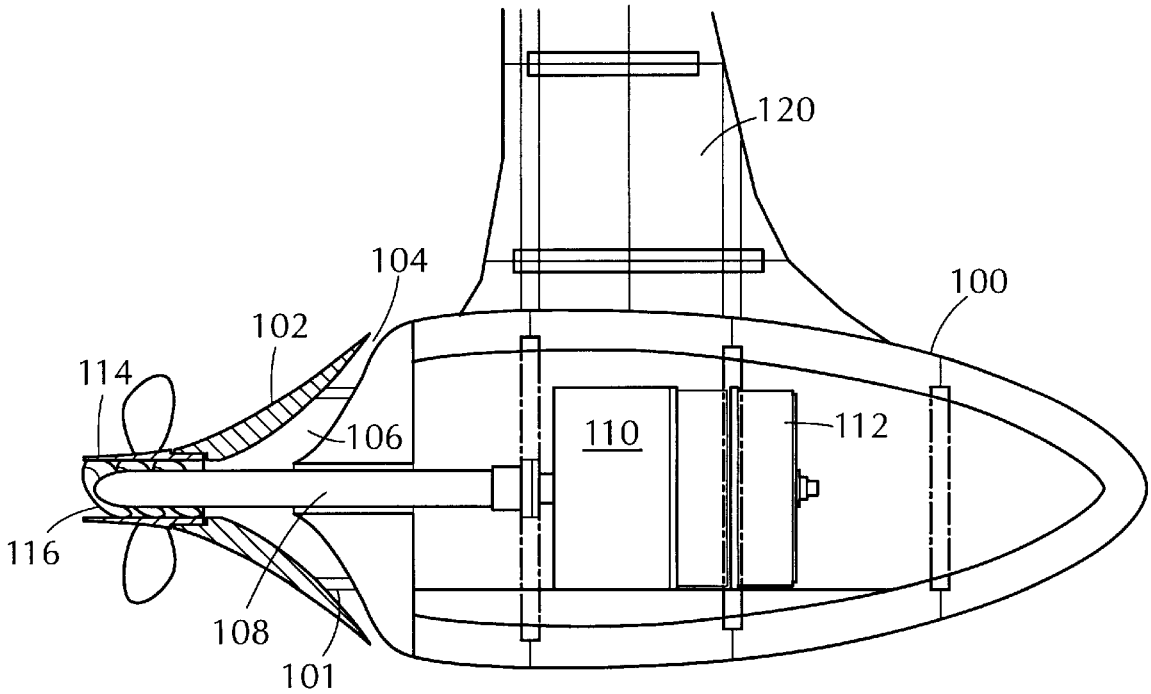
FIG. 29 is a sectional view of the lifting body shown in FIG. 28.

More specifically, when moving through water, a boundary layer of liquid forms along the surfaces of the hulls of the invention and follows the shape of the hull. The boundary layer can be captured and used to provide an improved propulsion system for the hull. As illustrated in FIGS. 28 and 29, a hull 100 constructed in accordance with the present invention has a portion of its stern section 102 separated and slightly/spaced from the main parabolic section to provide a water inlet 104 at that juncture. The stern section 102 is connected to the mail hull 100 by spaced frame elements 101 as would be understood by those skilled in the art.

The boundary layer of water will flow into inlet 104 and enter a recovery plenum 106. In accordance with an aspect of the invention, a propeller shaft 108 is mounted in the hull connected through a gear box 110 to an electric motor or the like 112. The shaft is connected in any convenient manner to a propeller hub 114, which is hollow and contains fixed within it the turbine vanes 116 of a jet impeller. Rotation of shaft 108 and impeller vanes 116 serve to draw the boundary layer into plenum 106 and jet it out of the end of the impeller. Additionally hub 114 has propeller vanes mounted thereon which rotate with the hub and fixed impeller vanes to provide additional motive power.

Figure 30:
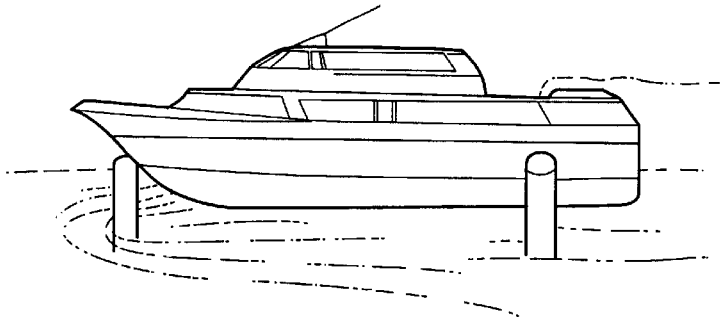
FIG. 30 (Prior Art)
FIG. 30 is a side view of a hydrofoil type vessel using the lifting body of FIGS. 28 and 29.
Figure 31:
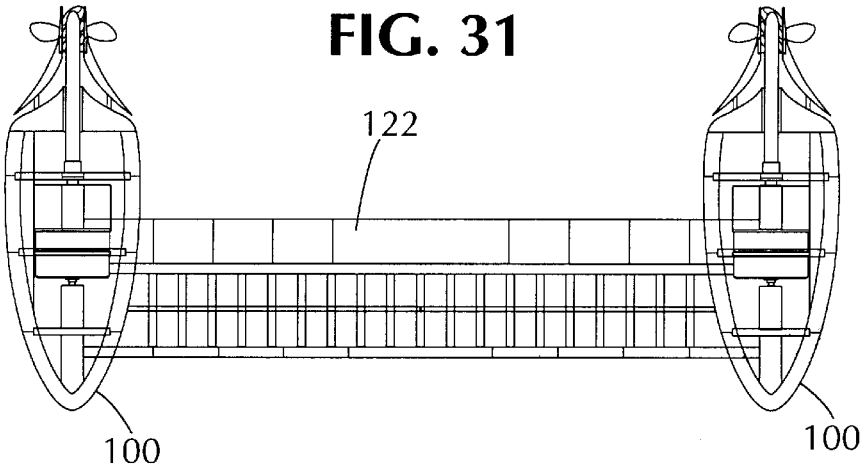
FIG. 31 is a schematic sectional plan view of the hydrofoil and two lifting bodies used on the rear foil of the vessel of FIG. 30.

In FIG. 29, hull 100 is illustrated as depending from a strut 120. The strut can depend from a SWATH vessel or from a conventional hydrofoil vessel as illustrated in FIG. 30. In that case, the aft hydrofoil 122 for the vessel (see FIG. 31) spans between two submerged hulls 100, each of which contains the same boundary layer drive system. With this arrangement, only a modest amount of power is needed for the boundary layer suction produced by the jet pump. The hybrid propeller and jet pump is more efficient than either an all water jet or a propeller design. Boundary layer pumping arrangements of this type also can be used with the foil shaped hulls of the present invention to capture the boundary layer flow along the hulls near the transition points from the parabolic cross-sectional shapes through the tapering aft section of the hull.

It is estimated that a 90% reduction in total body drag in the turbulent flow of water is in fact possible with boundary layer control of this type. The drag reduction is based on the development of static pressure thrust from the rear of the hulls (as opposed to drag) through the use of these boundary layer controls. Ingested water is integrated into the propulsion system as described above and injected out of the stern of the body. It is estimated that the lift to drag ratio can be increased by 300 to 500% using such an arrangement.

Although illustrative embodiments of the present invention have been described herein with reference to the accompanying drawings, it is to be understood that various changes and modifications may be effected therein by those skilled in the art without departing from the scope or spirit of this invention.

What is claimed is:

1. A three dimensional low drag underwater hull body for operation in a submerged state, said hull having a fore and aft axis and an outer surface whose shape conforms a) in plan to a first parabolic curve centered on the fore and aft axis to define a leading edge for the hull when viewed in plan and b) in longitudinal cross-sectional planes parallel to the fore and aft axis, to symmetrical and graduated generally parabolic foil curves having vertices lying on the first parabolic curve and which extend aft predetermined distances, with the thickness of the parabolic foil shaped longitudinal cross-sectional planes decreasing from the fore and aft axis of the hull to the edge of the hull; said hull having a bow and a stern and a predetermined hull length extending from the bow to the stern, and said first parabolic curve increasing in width from said bow to said stern with said stern being substantially straight and transverse of the hull length and located at the widest portion of the first parabolic curve.

2. A low drag underwater hull as defined in claim 1 wherein the hull's beam transversely of the fore and aft hull axis is equal to or greater than its thickness perpendicular to the beam and fore and aft axis.

3. A low drag underwater hull body as defined in claim 2 wherein the cross-sectional shape of the hull in both its fore and aft dimensions parallel to said fore and aft axis and in the plan dimension is substantially parabolic foil shaped at each plane intersecting the hull parallel to said fore and aft axis and plan dimensions.

4. A low drag underwater hull body as defined in claim 3 wherein the substantially parabolic foil shape of the hull at each of said planes intersecting the hull parallel to the fore and aft axis are symmetrical to the shapes of the hull at the planes parallel thereto but each is smaller at positions further from the center line fore and aft axis of the hull.

5. A low drag underwater hull body as defined in claim 2 wherein the maximum thickness of said hull is between 10% and 33% of the hull length.

6. A low drag underwater hull body as defined in claim 1 wherein the body's beam and thickness are equal and the hull is substantially a parabolic body of revolution from its bow to a predetermined point which is about two-thirds of the length of the hull from the bow, said hull tapering symmetrically from said predetermined point to a reduced thickness adjacent the stern of the hull.

7. A low drag underwater hull body as defined in claim 6 wherein the hull has an aspect ratio of 10% to 150%.

8. A three dimensional low drag underwater hull body for operation in a submerged state, said hull having a fore and aft axis and an outer surface whose shape conforms a) in plan to a first parabolic curve centered on the fore and aft axis to define a leading edge for the hull when viewed in plan and b) in longitudinal cross-sectional planes parallel to the fore and aft axis, to symmetrical and graduated generally parabolic foil curves having vertices lying on the first parabolic curve and which extend aft predetermined distances, with the thickness of the parabolic foil shaped longitudinal cross-sectional planes decreasing from the fore and aft axis of the hull to the edge of the hull;

said hull having a bow and a stern and a predetermined hull length extending from the bow to the stern, and said first parabolic curve increasing in width from said bow to said stern with said stern being defined by a third parabolic curve transverse to the hull length and located at the widest portion of the first parabolic curve.

9. A low drag underwater hull body as defined in claim 8 wherein the cross-sectional shape of the hull in both its fore and aft dimensions parallel to said fore and aft axis and in the plan dimension is substantially parabolic foil shaped at each plane intersecting the hull parallel to said fore and aft and plan dimensions.

10. A low drag underwater hull body as defined in claim 9 wherein the substantially parabolic foil shape of the hull at each of said planes intersecting the hull parallel to the fore and aft axis are symmetrical to the shapes of the hull at the planes parallel thereto but each is smaller at positions further from the center line for and aft axis of the hull.

11. A low drag underwater hull body as defined in claim 8 wherein the body's beam and thickness are equal and the hull is substantially a parabolic body of revolution from its bow to a predetermined point which is about two-thirds of the length of the hull from the bow, said hull tapering symmetrically from said predetermined point to a reduced thickness adjacent the stern of the hull.

12. A low drag underwater hull body as defined in claim 8 wherein the maximum thickness of said hull is between 10% and 33% of the hull length.

13. A low drag underwater hull body as defined in claim 8 wherein the hull has an aspect ratio of 10% to 150%.

14. A three dimensional low drag underwater hull body for operation in a submerged state, said hull having a fore and aft axis and an outer surface whose shape conforms a) in plan to a first parabolic curve centered on the fore and aft axis to define a leading edge for the hull when viewed in plan and b) in longitudinal cross-sectional planes parallel to the fore and aft axis, to symmetrical and graduated generally parabolic foil curves having vertices lying on the first parabolic curve and which extend aft predetermined distances, with the thickness of the parabolic foil shaped longitudinal cross-sectional planes decreasing from the fore and aft axis of the hull to the edge of the hull; said hull's beam transversely of the fore and aft hull axis being equal to or greater than its thickness perpendicular to the beam and fore and aft axis; said hull having a bow and a stern and a predetermined hull length, said stern including a straight section amidship transverse to the hull length, said straight stern section having opposed ends and two generally concavely fared stern sections respectively connecting the opposed ends of the straight stern section of the sides of the hull in plan.

15. A three dimensional low drag underwater hull body for operation in a submerged state, said hull having a fore and aft axis and an outer surface whose shape is defined by a) a leading edge for the hull when viewed in plan and b) in longitudinal cross-section planes by symmetrical generally parabolic foil curves having vertices lying on the leading edge of the hull and which extend aft predetermined distances; said hull having a midship section extending from bow to stern and port and starboard hull sections on opposite sides of said midship section, each of which is shaped as one half of a parabolic body of revolution whose parabolic formula is the same as that of said midship section; and wherein the parabolic foil shape of the hull in the length dimension in said midship section is uniform in planes intersecting the hull parallel to said fore and aft axis and between said port and starboard hull sections across the width of the hull body.

16. A low drag underwater hull body as defined in claim 15 wherein said hull has a predetermined hull length and said stern is substantially straight and transverse of the hull length.

17. A low drag underwater hull body as defined in claim 15 wherein said hull has a predetermined hull length and said stern is defined by a third parabolic curve transverse to the hull length.

18. A low drag underwater hull body as defined in claim 15 wherein said stern includes a straight section amidship transverse to the hull length, said straight stern section having opposed ends and two generally concavely fared stern sections respectively connecting the opposed ends of the straight stern section of the sides of the hull in plan.

19. A three dimensional low drag underwater hull body for operation in a submerged state, said hull having a fore and aft axis and an outer surface whose shape conforms a) in plan to a first parabolic curve centered on the fore and aft axis to define a leading edge for the hull when viewed in plan and b) in longitudinal cross-sectional planes parallel to the fore and aft axis, to symmetrical and graduated generally parabolic foil curves having vertices lying on the first parabolic curve and which extend aft predetermined distances, with the thickness of the parabolic foil shaped longitudinal cross-sectional planes decreasing from the fore and aft axis of the hull to the edge of the hull;

said hull's beam transversely of the fore and aft hull axis being equal to or greater than its thickness perpendicular to the beam and fore and aft axis;

said hull having a bow and a stern, a side periphery as viewed in plan, a predetermined length, and a stern section, said stern section having a progressively deceasing height dimension in cross-section parallel to the fore and aft axis of the hull from a point at each plane intersecting the hull parallel to the fore and aft axis which is about two-thirds of the length dimension from the intersection of such plane with said side periphery to the stern.

20. A low drag underwater hull body as defined in claim 19 wherein said stern is defined by a third parabolic curve transverse to the hull length.

21. A low drag underwater hull body as defined in claim 20 wherein the parabolic shape of the hull at each of said planes intersecting the hull parallel are symmetrical to the shapes of the hull at the planes parallel thereto but each is smaller at positions further from the center line for and aft axis of the hull.

22. A low drag underwater hull body as defined in claim 19 wherein said stern includes a straight section amidship transverse to the hull length, said stern section having opposed ends and two concavely fared stern sections respectively connecting the opposed ends of the straight stern section to the sides of the hull in plan.

23. A low drag underwater hull body as defined in claim 19 wherein the cross-sectional shape of the hull in both its fore and aft dimensions parallel to said fore and aft axis and in the plan dimension is substantially parabolic at each plane intersecting the hull parallel to said fore and aft and plan dimensions.

24. A three dimensional low drag underwater hull body for operation in a submerged state, said hull having a fore and aft axis, a bow and a stern, a midship section extending from bow to stern,, port and starboard hull sections on opposite sides of said midship section and an outer surface whose shape conforms, in longitudinal cross-sectional planes parallel to the fore and aft axis, to symmetrical and generally parabolic foil curves having vertices lying at the bow of the hull and which extend aft predetermined distances; each of said port and starboard hull section being shaped as one half of a parabolic body of revolution whose parabolic formula is the same as that of said midship section; the parabolic shape of the hull in the length dimension in said midship section being substantially uniform in planes intersecting the hull parallel to said fore and aft axis; said hull's beam transversely of the fore and aft hull axis being equal to or greater than its thickness perpendicular to the beam and fore and aft axis, said hull having a side periphery when viewed in plan, a predetermined length, and a stern section, said stern section having a progressively decreasing height dimension in cross-section parallel to the fore and aft axis of the hull from a point at each plane intersecting the hull parallel to the fore and aft axis which is about two thirds of the length dimension from the intersection of such plane with the side periphery to the stern.

25. A watercraft including a first hull having a surface waterline, a strut depending from the first hull and a second, three-dimensional underwater submerged displacement hull secured to said strut beneath the waterline during operation of the watercraft, said second hull having an outer surface whose shape is defined in elevation by substantially parabolic curves;

said second hull having a fore and aft axis, a bow and stern, a midship section extending from bow to stern, port and starboard second hull sections on opposite sides of said midship section, each of which is shaped as one half of a parabolic body of revolution whose parabolic formula is the same as that of said midship section, the parabolic shape of the hull in the length dimension in said midship section being substantially uniform in planes intersecting the second hull parallel to said fore and aft axis.

26. A watercraft including a first hull having a surface waterline, a strut depending from the first hull and a second, three-dimensional underwater submerged displacement hull secured to said strut beneath the waterline during operation of the watercraft, said second hull having an outer surface whose shape is defined in plan by a parabolic curve and in elevation by a substantially parabolic curve; said second hull having a bow and a stern, a side periphery as viewed in plan, a predetermined length, and a stern section, said stern section having a progressively decreasing height dimension in cross-section parallel to the fore and aft axis of the second hull from a point at each plane intersecting the second hull parallel to the fore and aft axis which is about two-thirds of the length dimension from the intersection of such plane with said side periphery to the stern.

27. A watercraft as defined in claim 26 wherein the second hull's beam is equal to or greater than its thickness.

28. A watercraft as defined in claim 27 wherein said first hull is a displacement hull.

29. A watercraft as defined in claim 28 wherein said first hull has a bow and a stern and includes a hydrofoil foil depending therefrom towards the bow.

30. A watercraft as defined in claim 29 wherein said first hull includes a pair of spaced catamaran hull sections adjacent the stern of the watercraft extending parallel to the longitudinal axis of the craft and wherein said strut is mounted to said first hull between said catamaran hulls.

31. A watercraft as defined in claim 30 wherein the cross-sectional shape of the second hull in both its fore and aft dimensions parallel to said fore and aft axis and in the plan dimension is substantially parabolic at each plane intersecting the second hull parallel to said fore and aft and plan dimensions.

32. A watercraft as defined in claim 31 wherein the parabolic shape of the second hull at each of said planes intersecting the hull parallel are symmetrical to the shape of the second hull at the planes parallel thereto but each is smaller at positions further from the center line for and aft axis of the second hull.

33. A watercraft as defined in claim 31 wherein the maximum thickness of said hull is between 10% and 33% of the hull length.

34. A watercraft as defined in claim 33 wherein the second hull has an aspect ratio of 10% to 150%.

35. A watercraft as defined in claim 28 wherein said second hull is retractable from a first extended position away from the first hull to a second position adjacent the first hull.

36. A watercraft as defined in claim 26 wherein said stern is defined by a third parabolic curve transverse to the second hull's length.

37. A self submerging watercraft comprising a three-dimensional displacement hull which at rest is partly submerged and having an outer surface whose shape is defined in plan by a parabolic curve and in elevation by a substantially parabolic foil curve whereby when in motion said hull will seek a predetermined submerged depth dependent on its forward speed;

said hull's beam being equal to or greater than its thickness; and said hull having a bow and a stern, a side periphery as viewed in plan, a predetermined length, and a stern section, said stern section having a progressively deceasing height dimension in cross-section parallel to the fore and aft axis of the hull from a point at each plane intersecting the hull parallel to the fore and aft axis which is about two-thirds of the length dimension from the intersection of such plane with said side periphery to the stern.

38. A watercraft as defined in claim 37 wherein said stern is defined by a third parabolic curve transverse to the hull length.

39. A watercraft as defined in claim 38 wherein the cross-sectional shape of the hull in its fore and aft dimensions parallel to said fore and aft axis is substantially parabolic at each plane intersecting the hull parallel to said fore and aft and plan dimensions.

40. A watercraft as defined in claim 39 wherein the parabolic shape of the hull at each of said planes intersecting the hull are symmetrical to the shapes of the hull at the planes parallel thereto but each is smaller at positions further from the center line for and aft axis of the hull.

41. A watercraft as defined in claim 37 wherein the maximum thickness of said hull is between 10% and 33% of the hull length.

42. A watercraft as defined in claim 41 wherein the hull has an aspect ratio of 10% to 150%.

43. A self submerging watercraft as defined in claim 37 wherein said stern section is formed with at least one surface which is generally concave to the plane in which said side periphery lies.

44. A three dimensional low drag underwater hull body for operation in a submerged state, said hull having a fore and aft axis and an outer surface whose shape conforms a) in plan to a first parabolic curve centered on the fore and aft axis to define a leading edge for the hull when viewed in plan and b) in longitudinal cross-sectional planes parallel to the fore and aft axis, to symmetrical and graduated generally parabolic foil curves having vertices lying on the first parabolic curve and which extend aft predetermined distances, with the thickness of the parabolic foil shaped longitudinal cross-sectional planes decreasing from the fore and aft axis of the hull to the edge of the hull; said hull's beam transversely of the fore and aft hull axis being greater than its thickness perpendicular to the beam and fore and aft axis; and said hull having a bow and stern and a predetermined hull length, a side periphery as viewed in plan, and a stern section having a progressively decreasing thickness in cross-sections parallel to the fore and aft axis of the hull from a point at each plane intersecting the hull parallel to the foe and aft axis which is about two thirds of the length dimension from the intersection of such plane with said side periphery to the stern; said stern section being formed with at least one surface which is generally concave relative to the plane on which said side periphery lies.

45. A three dimensional low drag underwater hull body for operation in a submerged state, said hull having a fore and aft axis and an outer surface whose shape conforms a) in plan to a first parabolic curve centered on the fore and aft axis to define a leading edge for the hull when viewed in plan and b) in longitudinal cross-sectional planes parallel to the fore and aft axis, to symmetrical and graduated generally parabolic foil curves having vertices lying on the first parabolic curve and which extend aft predetermined distances, with the thickness of the parabolic foil shaped longitudinal cross-sectional planes decreasing from the fore and aft axis of the hull to the edge of the hull;

said hull's beam transversely of the fore and aft hull axis being equal to or greater than its thickness perpendicular to the beam and fore and aft axis;

the cross-sectional shape of the hull in both its fore and aft dimensions parallel to said fore and aft axis and in the plan dimension being substantially parabolic foil shaped at each plan intersecting the hull parallel to said fore and aft and plan dimensions; and the substantially parabolic foil shape of the hull at each of said planes intersecting the hull parallel to the fore and aft axis being symmetrical to the shapes of the hull at the planes parallel thereto but each is smaller at positions further from the center line for and aft axis of the hull;

said hull having a bow and a stern and a predetermined hull length, said stern including a straight section amidship transverse to the hull length, said straight stern section having opposed ends and two generally concavely fared stern sections respectively connecting the opposed ends of the straight stern section of the sides of the hull in plan.

* * * * *